US007138359B2

(12) United States Patent
Washizuka

(10) Patent No.: US 7,138,359 B2
(45) Date of Patent: Nov. 21, 2006

(54) HEAT TRANSFER RECORDING MEDIUM AND PRINTED PRODUCT

(75) Inventor: Junichi Washizuka, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 11/015,648

(22) Filed: Dec. 20, 2004

(65) Prior Publication Data

US 2005/0101483 A1 May 12, 2005

Related U.S. Application Data

(62) Division of application No. 10/167,502, filed on Jun. 13, 2002, now abandoned.

(30) Foreign Application Priority Data

| | | |
|---|---|---|
| Jun. 18, 2001 | (JP) | 2001-183649 |
| Sep. 19, 2001 | (JP) | 2001-285475 |
| Sep. 19, 2001 | (JP) | 2001-285815 |
| Dec. 10, 2001 | (JP) | 2001-376039 |

(51) Int. Cl.
*B41M 5/035* (2006.01)
*B41M 5/38* (2006.01)

(52) U.S. Cl. ..... 503/227; 428/32.51

(58) Field of Classification Search ..... 428/32.51; 503/227

See application file for complete search history.

(56) References Cited

U.S. PATENT DOCUMENTS

| | | | |
|---|---|---|---|
| 4,720,480 | A | 1/1988 | Ito et al. |
| 4,837,200 | A | 6/1989 | Kondo et al. |
| 5,169,468 | A | 12/1992 | Royce et al. |
| 5,395,720 | A | 3/1995 | Jongewaard et al. |
| 5,439,872 | A | 8/1995 | Ito et al. |
| 5,580,693 | A | 12/1996 | Nakajima et al. |
| 5,759,738 | A | 6/1998 | Tsuno et al. |
| 5,759,954 | A | 6/1998 | Taguchi et al. |
| 5,821,028 | A | 10/1998 | Maejima et al. |
| 5,981,077 | A | 11/1999 | Taniguchi |

FOREIGN PATENT DOCUMENTS

| | | |
|---|---|---|
| EP | 0 550 050 A1 | 7/1993 |
| EP | 0 588 716 A2 | 3/1994 |

*Primary Examiner*—Bruce Hess
(74) *Attorney, Agent, or Firm*—Pillsbury Winthrop Shaw Pittman, LLP

(57) ABSTRACT

A heat transfer recording medium includes a protective layer containing mainly a polyvinylbutyral resin, phenoxy resin, or polyvinylacetal resin, an adhesive layer having a glass transition point Tg1 falling within the range Tg1≦T−80° C., an ink image receiving layer/adhesive layer having a glass transition point Tg2 falling within the range 60° C.≦Tg2≦Tg−50° C., and a hot-melt ink image receiving layer/adhesive layer in which a first resin component having a number-average molecular weight of 16,000 or more and a glass transition point of Tg−80° C. or less and a second resin component having a number-average molecular weight of 16,000 or less and a glass transition point of Tg−50° C. or more are mixed at a weight ratio of 1:9 to 5:5.

13 Claims, 4 Drawing Sheets

HEAT TRANSFER RECORDING MEDIUM AND PRINTED PRODUCT

CROSS-REFERENCE TO RELATED APPLICATIONS

This is a divisional application of U.S. patent application Ser. No. 10/167,502, filed Jun. 13, 2002 now abandoned, which is based upon and claims the benefit of priority from Japanese Patent Applications No. 2001-183649, filed Jun. 18, 2001, No. 2001-285475, filed Sep. 19, 2001, No. 2001-285815, filed Sep. 19, 2001, and No. 2001-376039, filed Dec. 10, 2001, the entire contents of all of which are incorporated herein by reference in their entireties.

BACKGROUND OF THE INVENTION

1. Field of the Invention

The present invention relates to a heat transfer recording medium having an image receiving layer formed on a support member, and capable of forming an image by hot-melt ink or sublimating heat transfer ink and thermally adhering the layer onto a recording medium such as paper or plastic, and to a printed product obtained by using this heat transfer recording medium.

2. Description of the Related Art

A sublimation type heat transfer recording method is most often used as a method of recording a face image for personal authentication onto an image display body such as a license, employee's ID card, member's card, or credit card.

In this sublimation type heat transfer recording method, a sublimating ink ribbon formed by coating a support sheet with ink containing a sublimating (or heat flowing) dye such that heat transfer is possible, is overlayed on a recording medium having an image receiving layer made of a thermoplastic resin capable of accepting the sublimating dye. The heat transfer ribbon is selectively heated on the basis of image data by a thermal head or the like, thereby forming a desired image on the recording medium by sublimation type heat transfer recording. It is widely known that color images superior in tone reproduction can be easily recorded by this method. However, this sublimation type heat transfer recording method has the problems related to the durability of a card. For example, an image is easily scratched because it is formed near the face region of thermoplastic resin layer, the dye sublimates again to lower the image density with time, and ultraviolet radiation decomposes the dye to change the tone of color of an image.

A melting type heat transfer recording method is also usable. In this method, a hot-melt ink transfer ribbon formed by coating a support sheet with hot-melt ink in which a coloring pigment or dye is dispersed in a binder such as a resin or wax, is overlayed on a recording medium having an image receiving layer made of a thermoplastic resin capable of accepting the hot-melt ink transfer ribbon. The heat transfer ribbon is selectively heated on the basis of image data by a thermal head or the like, thereby recording a desired image by transferring the binder-containing hot-melt ink onto the recording medium. In this method, inorganic or organic pigments generally having high lightfastness can be selectively used as the coloring material. Also, by improving the resin or wax used as the binder, it is possible to provide images hard to scratch and superior in solvent resistance. In addition, special high-security ink is readily formable by mixing a functional material such as a fluorescent pigment or magnetic substance into the ink. The image receiving layer can be any recording medium provided that the medium has a surface adhesive to the binder. So, the image receiving layer can be chosen from various recording media. As described above, this melting type heat transfer recording method is advantageous for the sublimation type heat transfer method.

Still another method is proposed in which an image is formed on a transparent transfer type image receiving layer formed on a base film by the sublimation heat transfer recording method or the melting type heat transfer recording method described above, and this transfer type image receiving layer on which the image is recorded is thermally transferred onto a recording medium such as paper. In this method, after transferring the transfer type image receiving layer itself can function as a surface protective film, so the mechanical strength of the surface is high. Also, by improving the smoothness of the transfer type image receiving layer surface and thereby increasing the affinity to the ink layer, images excellent in tone reproduction can be formed even by the melting type heat transfer method.

Unfortunately, if a printed product on which a transfer type image receiving layer is formed by the above method is stored for long time periods in contact with a film containing a plastic material e.g., a vinyl chloride resin, such as used in a transparent resin cover, this plastic material moves to the transfer type image receiving layer and is fused to the vinyl chloride resin or the like. If this plastic material is peeled, the transfer type image receiving layer is removed from the final recording medium. Alternatively, if a sublimating ink image is recorded on a printed product, the sublimating dye becomes readily diffusible. This smears the contour of the image or discolors the image.

That is, a transfer type image receiving layer formed by the conventional method cannot be stored for long time periods if a resin film containing a plastic material is overlayed on the layer.

Also, the melting type heat transfer recording method basically performs ink adhesion and uses a dot area modulation tone recording method in which tone recording is performed by changing the sizes of transferred dots. Therefore, the method is very sensitive to the surface unevenness of a recording medium to which an image is to be transferred. If the surface is uneven, inferior transfer occurs to make dot size control impossible, resulting in poor tone reproduction.

Various proposals have been made to solve the above problems. One proposed method uses a recording medium having a porous image receiving layer. In this method, fine pores are formed in an image receiving layer of a recording medium, and hot-melt ink is transferred into these fine pores by permeation. This method can provide images superior in tone reproduction. However, a porous image receiving layer generally has low mechanical strength, so the surface is scratched when brought into contact with various rollers and a convey path in a printing apparatus, resulting in image defects.

In another proposed method, an image is formed on a resin layer obtained by forming a transparent image receiving layer/adhesive layer on a film base, and this image receiving layer/adhesive layer is heated and pressurized to adhere or heated transfer onto a base such as paper or plastic to which the image is to be given. In this method, no fine pores are formed in the image receiving layer, so the mechanical strength of the surface is high. In addition, by improving the smoothness of the resin layer surface and thereby increasing the affinity to the ink layer, images excellent in tone reproduction can be formed even by the melting type heat transfer method.

Unfortunately, the above method has the problem that if a low-softening-temperature resin having high adhesion to paper or plastic is used as the image receiving layer/adhesive layer, the reproducibility of the recording image density becomes unstable under the same recording conditions. This is so because a state (center omission) in which no ink is present in the centers of pixel points constructing a transferred ink image occurs.

To prevent this center omission of each pixel point, a resin having a high softening temperature can be used in the image receiving layer/adhesive layer. However, this lowers the adhesion to the base such as paper or plastic.

As described above, a melting type heat transfer recording image receiving layer formed by the conventional method cannot prevent center omission and ensure sufficient adhesion to paper or plastic at the same time.

BRIEF SUMMARY OF THE INVENTION

It is the first object of the present invention to provide a heat transfer recording medium having an image receiving layer excellent in image printing characteristics when a sublimation type heat transfer recording method or a melting type heat transfer recording method is used, and a protective film which, even when stored as it is overlayed on a resin containing a plastic material, causes neither fusion to the resin nor deterioration of an image and hence can be stably stored for long time periods.

It is the second object of the present invention to provide a printed product which has excellent image printing characteristics when a sublimation type heat transfer recording method or a melting type heat transfer recording method is used, and which, even when stored as it is overlayed on a resin containing a plastic material, causes neither fusion to the resin nor deterioration of an image and hence can be stably stored for long time periods.

It is the third object of the present invention to provide a heat transfer recording medium which has excellent image printing characteristics when a melting type heat transfer recording-method is used, from which a stable image density is obtained whenever recording is performed, which can form a high-quality image superior in tone reproduction, and which has sufficient adhesion to a base.

According to a first aspect of the invention, there is provided a heat transfer recording medium comprising a support member, a protective layer formed on the support member and containing mainly a polyvinylbutyral resin, phenoxy resin, or polyvinylacetal resin, and a thermally adhesive hot-melt ink image receiving layer and/or sublimating ink image receiving layer formed on the protective layer.

According to a second aspect of the invention, there is provided a printed product comprising a protective layer containing mainly a polyvinylbutyral resin, phenoxy resin, or polyvinylacetal resin, a thermally adhesive hot-melt ink image receiving layer and/or sublimating ink image receiving layer stacked on the protective layer, a hot-melt ink image and/or sublimating ink image received on the hot-melt ink image receiving layer, and a base thermally adhered to the image receiving layer via the hot-melt ink image.

According to a third aspect of the invention, there is provided a heat transfer recording medium comprising a support member, an adhesive layer formed on the support member and having a first glass transition point Tg1, and a hot-melt ink image receiving layer/adhesive layer formed on the adhesive layer and having a second glass transition point Tg2 higher than the first glass transition point Tg1, wherein letting Tg be the glass transition point of hot-melt ink and T be the thermal adhesion temperature, the first glass transition point Tg1 falls within the range Tg1≦T−80° C., and the second glass transition point Tg2 falls within the range 60° C.≦Tg2≦Tg−50° C.

According to a fourth aspect of the invention, there is provided a heat transfer recording medium for recording an image by using hot-melt ink, comprising a support member, and a hot-melt ink image receiving layer/adhesive layer formed on the support member and containing at least first and second resin components, the first resin component having a number-average molecular weight of 16,000 or more and, letting Tg be the glass transition point of hot-melt ink, having a glass transition point of Tg−80° C. or less, the second resin component having a number-average molecular weight of 16,000 or less and a glass transition point of Tg−50° C. or more, and a weight mixing ratio of the first resin component to the second resin component being 1:9 to 5:5.

According to a fifth aspect of the invention, there is provided a printed product comprising a base, hot-melt ink image layer, and hot-melt ink image receiving layer/adhesive layer in turn, wherein the hot-melt ink image receiving layer/adhesive layer contains a first resin component having a number-average molecular weight of 16,000 or more and, letting Tg be the glass transition point of hot-melt ink, having a glass transition point of Tg−80° C. or less, and a second resin component having a number-average molecular weight of 16,000 or less and a glass transition point of Tg−50° C. or more, a weight mixing ratio of the first resin component to the second resin component being 1:9 to 5:5.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention and, together with the generation description given above and the detailed description of the preferred embodiments given below, serve to explain the principles of the invention.

DETAILED DESCRIPTION OF THE INVENTION

The first heat transfer recording medium of the present invention comprises a structure in which a protective layer and an image receiving layer capable of accepting thermally adhesive hot melt ink and/or sublimating ink are stacked in this order on a support member, wherein the protective layer contains a polyvinylbutyral resin, phenoxy resin, or polyvinylacetal resin as a main component.

The first printed product of the present invention is obtained by performing melting type or sublimation type heat transfer recording on an image receiving layer of the heat transfer recording medium described above, bringing this image receiving layer into contact with a base, thermally transferring the image receiving layer together with the protective layer onto to the base, and removing the support member. This printed product comprises a protective layer, an image receiving layer stacked on the protective layer and capable of accepting thermally adhesive hot-melt ink and/or sublimating ink, an image formed on the image receiving layer by hot-melt ink and/or sublimating ink, and a base thermally adhered to the image receiving layer via the image, wherein the protective layer contains a polyvinylbutyral resin, phenoxy resin, or polyvinylacetal resin as a main component.

When the printed product as described above is formed using the first heat transfer recording medium of the present invention, the image and the image receiving layer are interposed between the base and the protective layer, and the protective layer is exposed to the surface of the printed product. In the present invention, this protective layer contains mainly a polyvinylbutyral resin, phenoxy resin, or polyvinylacetal resin. Accordingly, the printed product can be well stored for long time periods without causing fusion to a plastic material such as a vinyl chloride resin and image deterioration resulting from the movement of a dye or the like.

The content of the polyvinylbutyral resin, phenoxy resin, or polyvinylacetal resin in the protective layer is preferably 50 wt % or more. If this content is less than 50 wt %, it is often impossible to well prevent fusion to a plastic material. The content is more preferably 80 wt % or more.

The present invention will be described in more detail below with reference to the accompanying drawing.

Figure 1:
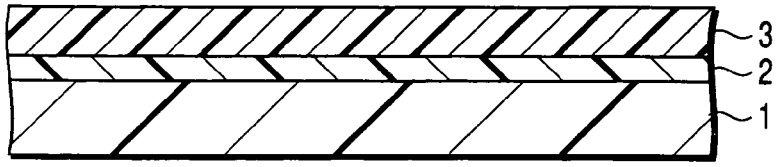
FIG. 1 is sectional view showing the structure of an example of a first heat transfer recording medium according to the present invention.

FIG. 1 is a sectional view showing the structure of an example of the first heat transfer recording medium according to the present invention.

As shown in FIG. 1, this heat transfer recording medium has a support sheet 1 made of, e.g., polyethyleneterephthalate, a protective layer 2 formed on the support sheet 1 and essentially consisting of a polyvinylbutyral resin, phenoxy resin, or polyvinylacetal resin, and an image receiving layer 3 formed on the protective layer 2 and made of a resin capable of accepting sublimating ink which is a mixture of, e.g., a polyester resin and silicone resin.

Figure 2:
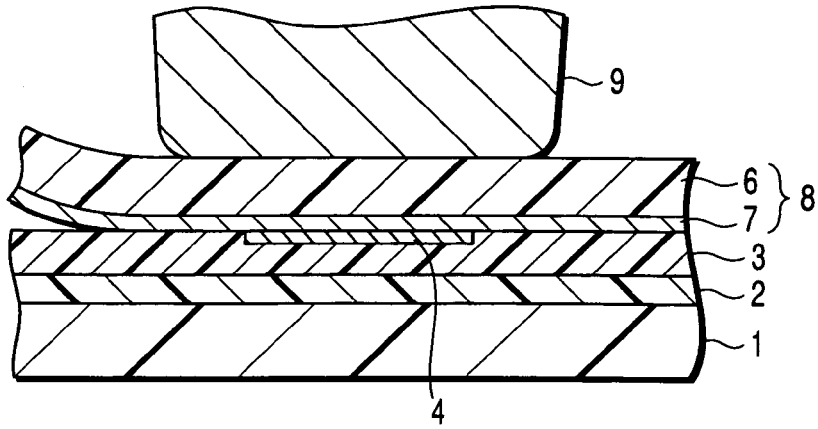
FIG. 2 is a sectional view showing a manufacturing step of an example of a first printed product according to the present invention.

FIG. 2 shows the way an image is formed on the heat transfer recording medium shown in FIG. 1 by sublimation type heat transfer recording by using sublimating ink.

First, a sublimating ink ribbon 8 having an ink ribbon support 6 and a sublimating ink layer 7 formed on the ink ribbon support 6 is prepared. As shown in FIG. 2, this sublimating ink layer 7 is placed on the sublimating ink image receiving layer 3, and sublimation type heat transfer recording is performed from the side of the ink ribbon support 6 in accordance with an image signal by using, e.g., a thermal head 9. Consequently, a sublimating ink image can be formed in the image receiving layer 3. Reference numeral 4 in FIG. 2 denotes a sublimating ink image region in the image receiving layer 3. After the image formation, the sublimating ink ribbon 8 is removed from the surface of the sublimating ink image receiving layer 3.

Figure 3:
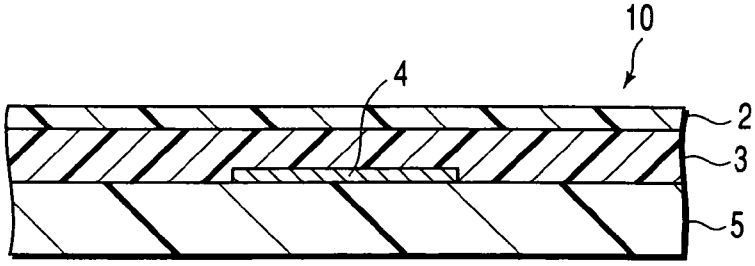
FIG. 3 is a sectional view showing the structure of the example of the first printed product according to the present invention.

FIG. 3 is a sectional view showing the structure of an example of the first printed product of the present invention, which is formed by using a heat transfer recording medium having a sublimating ink image.

As shown in FIG. 3, this printed product 10 has a base 5 made of, e.g., polyethyleneterephthalate, an image receiving layer 3 which accepts a sublimating ink image region 4 and is thermally adhered onto the base 5 via this sublimating ink image region 4, and a protective layer 2 stacked on the image receiving layer 3 and made essentially consisting of a polyvinylbutyral resin, phenoxy resin, or polyvinylacetal resin.

This printed product 10 is obtained by setting, on the base 5, the image receiving layer 3 of the heat transfer recording medium in which the sublimating ink image region 4 is formed, thermally adhering the image receiving layer 3 and the base 5 by heat and pressure, and peeling the support sheet 1 off the protective layer 2 after that.

Figure 4:
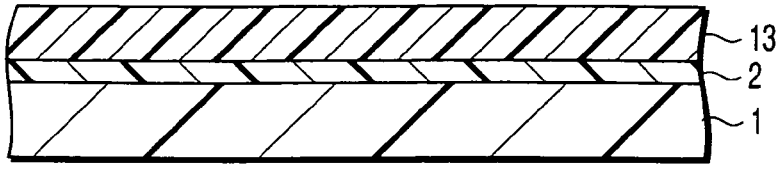
FIG. 4 is a sectional view showing the structure of another example of the first heat transfer recording medium according to the present invention.

FIG. 4 is a sectional view showing the structure of another example of the first heat transfer recording medium of the present invention.

As shown in FIG. 4, this heat transfer recording medium has a support sheet 1 made of, e.g., polyethyleneterephthalate, a protective layer 2 formed on the support sheet 1 and essentially consisting of a polyvinylbutyral resin, phenoxy resin, or polyvinylacetal resin, and an image receiving layer 13 formed on the protective layer 2 and made of, e.g., a resin capable of accepting hot-melt ink consisting of, e.g., acryl resin.

Figure 5:
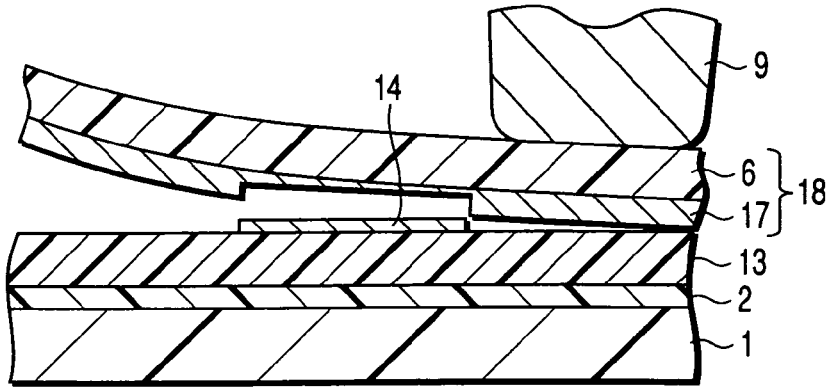
FIG. 5 is a sectional view showing a manufacturing step of another example of the first printed product according to the present invention.

FIG. 5 is a sectional view showing the way an image is formed on the heat transfer recording medium shown in FIG. 3 by heat melting type heat transfer recording by using hot-melt ink.

First, a hot-melt ink ribbon 18 having an ink ribbon support 6 and a hot-melt ink layer 17 formed on the ink ribbon support 6 is prepared. As shown in FIG. 5, this hot-melt ink layer 17 is placed on the hot-melt ink image receiving layer 13, and heat melting type heat transfer recording is performed from the side of the ink ribbon support 6 in accordance with an image signal by using, e.g., a thermal head 9. Consequently, a hot-melt ink image layer 14 can be formed on the image receiving layer 13. After the image formation, the hot-melt ink ribbon 18 is removed from the surface of the hot-melt ink image receiving layer 13.

Figure 6:
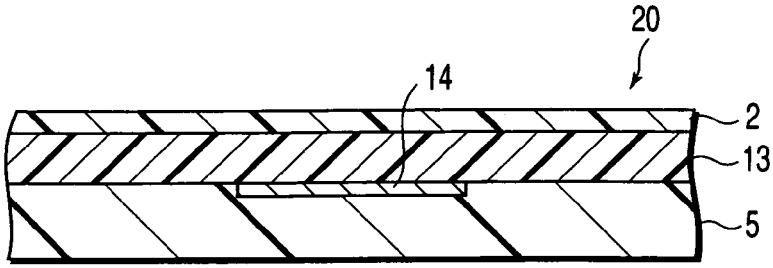
FIG. 6 is a sectional view showing the structure of the other example of the first printed product according to the present invention.

FIG. 6 is a sectional view showing the structure of another example of the first printed product of the present invention, which is formed by using a heat transfer recording medium having a hot-melt ink image.

As shown in FIG. 6, this printed product 20 has a base 5 made of, e.g., polyethyleneterephthalate, a hot-melt ink image layer 14 formed in the support member 5, an image receiving layer 13 thermally adhered onto the base 5 via the hot-melt ink image layer 14, and a protective layer 2 stacked on the image receiving layer 13 and essentially consisting of a polyvinylbutyral resin, phenoxy resin, or polyvinylacetal resin.

This printed product 20 is obtained by setting, on the base 5, the image receiving layer 13 of the heat transfer recording medium in which the hot-melt ink image layer 14 is formed, thermally adhering the image receiving layer 13 and the base 5 by heat and pressure via the hot-melt ink image layer 14, and peeling the support sheet 1 off the protective layer 2 after that.

The protective layer desirably has not only a function of preventing fusion and movement of a plastic material but also properly controlled adhesive force to the support member. If this adhesive force is too large, the support member becomes difficult to peel after thermal adhesion. If unnecessarily large force is applied, the support member peels together with the protective layer and image receiving layers so these layers cannot be left behind on the base. If the adhesive force is too small, the protective layer and image receiving layer in an undesired region other than the thermally adhered region are also transferred onto the base.

As a resin having this proper adhesive force, a polyvinylbutyral resin, phenoxy resin, or polyvinylacetal resin is used in the present invention.

Examples of a polyvinylbutyral resin suitable as the protective layer are S-lec BL-1, S-lec BL-2, S-lec BL-3, S-lec BL-S, S-lec BX-L, S-lec BM-1, S-lec BM-2, S-lec BM-5, S-lec BM-S, S-lec BH-3, S-lec BH-S, S-lec BX-1, S-lec BX-2, S-lec BX-5, and S-lec BX-55 (trademarks) manufactured by Sekisui Chemical Co., Ltd., and DENKABUTYRAL #2000-L, DENKABUTYRAL #3000-1, DENKABUTYRAL #3000-2, DENKABUTYRAL #3000-4, DENKABUTYRAL #3000-K, DENKABUTYRAL #4000-1, DENKABUTYRAL #4000-2, DENKABUTYRAL #5000-A, DENKABUTYRAL #6000-C, and DENKABUTYRAL #6000-EP (trademarks) manufactured by DENKI KAGAKU KOGYO K.K.

Examples of a phenoxy resin suitable as the protective layer are PKHH, PKHJ, PKHW-35, PKHW-35R, PXKS-6994, and PXKS-7000 (trademarks) manufactured by Union Carbide, and YP-50, YP-50S, YP-40ASM40, YP-50EK35, and YPB-40AM40 (trademarks) manufactured by TOTO KASEI K.K.

Examples of a polyvinylacetal resin suitable as the protective layer are S-lec KS-1, S-lec KS-5, S-lec KX-1, and S-lec KW-1 (trademarks) manufactured by Sekisui Chemical Co., Ltd.

In addition to the polyvinylbutyral resin, phenoxy resin, and polyvinylacetal resin described above, small amounts of a polyester resin, epoxy resin, tackifier, and the like can also be added to the protective layer. For example, the adhesive force to the base can be increased by adding a polyester resin, and the peeling force can be controlled by the addition amount. The adhesion force to the base can be decreased by adding an epoxy resin.

The protective layer can be used singly or in combination with, e.g., an ultraviolet absorbing layer or a solvent-resistant layer. When the protective layer is combined with an ultraviolet absorbing layer, discoloration of a recorded image by ultraviolet radiation can be reduced. When the protective layer is combined with a solvent-resistant layer, damage by an organic solvent can be prevented.

A resin used in the image receiving layer is preferably superior in the dye-accepting properties of the sublimating ink and/or the adhesion properties to the hot-melt ink, and also preferably has large adhesive force to the base such as paper or plastic.

Examples of a resin meeting these conditions are a vinyl acetate resin, ethylene-vinyl acetate copolymer resin, acrylic resin, polyester resin, polyurethane resin, phenoxy resin, and mixtures of these resins.

The sublimating ink image receiving layer is preferably an acrylic resin, polyester resin, polyurethane resin, or phenoxy resin.

The hot-melt ink image receiving layer is favorably a vinyl acetate resin, ethylene-vinyl acetate copolymer resin, polyester resin or phenoxy resin. If the adhesion to the hot-melt ink is high, the sublimating ink image receiving layer can also be used.

Practical examples of the vinyl acetate resin are SAKNOHOL SN-04, SAKNOHOL SN-04S, SAKNOHOL SN-04D, SAKNOHOL SN-09A, SAKNOHOL SN-09T, SAKNOHOL SN-10, SAKNOHOL SN-10N, SAKNOHOL SN-17A, ASR CH-09, and ASR CL-13 (trademarks) manufactured by DENKI KAGAKU KOGYO K.K., Movinyl DC (trademark) manufactured by Kurarianto Polymers K.K., and Cevian A530, Cevian A700, Cevian A707, Cevian A710, Cevian A712, and Cevian A800 (trademarks) manufactured by Daiseru Kaseihin K.K.

Practical examples of the ethylene-vinyl acetate copolymer resin are EVAFLEX 45X, EVAFLEX 40, EVAFLEX 150, EVAFLEX 210, EVAFLEX 220, EVAFLEX 250, EVAFLEX 260, EVAFLEX 310, EVAFLEX 360, EVAFLEX 410, EVAFLEX 420, EVAFLEX 450, EVAFLEX 460, EVAFLEX 550, and EVAFLEX 560 (trademarks) manufactured by Du Pont-Mitsui Polychemicals Co., Ltd., Movinyl 081F (trademark) manufactured by Kurarianto Polymers K.K., EVATATE D3022, D3012, D4032, and CV8030 (trademarks) manufactured by SUMITOMO CHEMICAL CO., LTD., Hirodain 1800-5, Hirodain 1800-6, Hirodain 1800-8, Hirodain 3706, and Hirodain 4309 (trademarks) manufactured by Hirodain Kogyo K.K., and BOND CZ250 and BOND CV3105 (trademarks) manufactured by KONISHI K.K.

Practical examples of the acrylic resin are Cevian A45000, Cevian A45610, Cevian A46777, and Cevian A4635 (trademarks) manufactured by Daiseru Kaseihin K.K., Dianal BR-80, Dianal BR-83, Dianal BR-85, Dianal BR-87, Dianal BR-101, Dianal BR-1002, Dianal BR-105, Dianal BR-106, Dianal BR-50, Dianal BR-52, Dianal BR-60, Dianal BR-73, Dianal BR-75, Dianal BR-77, Dianal BR-80, Dianal BR-82, Dianal BR-83, Dianal BR-85, Dianal BR-87, Dianal BR-88, Dianal BR-95, Dianal BR-100, Dianal BR-108, and Dianal BR-113 (trademarks) manufactured by Mitsubishi Rayon Co., Ltd.

Practical examples of the polyester resin are VYLON 200, VYLON 220, VYLON 240, VYLON 245, VYLON 280, VYLON 296, VYLON 530, VYLON 560, VYLON 600, VYLON 290, VYLONAL MD1100, VYLONAL MD1200, VYLONAL MD1245, VYLONAL MD1400, and VYLONAL GX-W27 (trademarks) manufactured by TOYOBO CO., LTD., and ELITEL UE-3300, ELITEL UE-3320, ELITEL UE-3350, ELITEL UE-3370, ELITEL UE-3380, ELITEL UE-3600, ELITEL UE-9600, and ELITEL UE-3690 (trademarks) manufactured by UNITIKA, LTD.

Practical examples of the polyurethane resin are Solucote 1051, Solucote 1051-1, Solucote 1054-1, and Solucote 1059 (trademarks) manufactured by Daiseru Kaseihin K.K.

Practical examples of the phenoxy resin suitable as the image receiving layer are PKHH, PKHJ, PKHW-35, PKHW-35R, PXKS-6994, and PXKS-7000 (trademarks) manufactured by Union Carbide, and YP-50, YP-50S, YP-40ASM40, YP-50EK35, and YPB-40AM40 (trademarks) manufactured by TOTO KASEI K.K.

The protective layer and the image receiving layer having good image receiving characteristics can be formed by preparing coating solutions containing the above-mentioned resins, forming layers of these solutions by, e.g., gravure coating, reverse coating, die coating, wire bar coating, or hot-melt coating, and drying the layers.

The second heat transfer recording medium of the present invention basically has a structure in which an adhesive layer having a first glass transition point and a hot-melt ink image receiving layer/adhesive layer having a second glass transition point higher than the first glass transition point are stacked in this order on a support member. The first glass transition point Tg1 falls within the range Tg1≦T−80° C., and the second glass transition point Tg2 falls within the range 60° C.≦Tg2≦Tg−50° C. where the glass transition point of hot-melt ink is Tg and the thermal adhesion temperature is T.

The hot-melt ink image receiving layer/adhesive layer functions as an ink accepting layer/adhesive layer which accepts hot-melt ink and can adhere to a given base such as paper or plastic. The adhesive layer contributes to the adhesive action during thermal adhesion together with the hot-melt ink image receiving layer/adhesive layer. The support member can function as a protective layer.

In this second heat transfer recording medium, a protective layer which can be peeled off the support member can be formed between the support member and the adhesive layer. However, the support member of this heat transfer recording medium can be peeled off after thermal adhesion. As this protective layer, it is possible to use that protective layer of the first heat transfer recording medium described above, which contains mainly a resin selected from the group consisting of a polyvinylbutyral resin, phenoxy resin, and polyvinylacetal resin.

Furthermore, if the base applied is opaque, the support member, protective layer, adhesive layer, and hot-melt ink image receiving layer/adhesive layer are favorably substantially transparent.

In the second heat transfer recording medium, while an image is formed by hot-melt ink, the hot-melt ink image receiving layer/adhesive layer having the second glass transition point Tg2 higher than the first glass transition point Tg1 and falling within the range 60° C.≦Tg2≦Tg−50° C. functions as an accepting layer, so no center omission occurs. This is probably because the hot-melt ink image receiving layer/adhesive layer has an appropriate adhesive force and hardness at the heat transfer temperature of the hot-melt ink.

Also, when this second heat transfer recording medium is thermally adhered to a desired base, the thermal adhesion temperature melts not only the hot-melt ink image receiving layer/adhesive layer but also the adhesive layer having the first glass transition point Tg1 lower than the second glass transition point Tg2 and falling within the range Tg1≦T−80° C. The melting of this adhesive layer helps adhere the heat transfer recording medium to the base. This makes it possible to ensure sufficient adhesion properties which cannot be obtained by the adhesive action of the hot-melt ink image receiving layer/adhesive layer alone.

If the glass transition point of the adhesive layer is higher than the thermal adhesion temperature T−80° C., no sufficient adhesive force can be obtained during thermal adhesion. If the glass transition point of the hot-melt ink image receiving layer/adhesive layer is less than 60° C., films are fused together when stored at high temperatures. If this glass transition point is higher than the hot-melt ink glass transition point Tg−50° C., the adhesive force to the hot-melt ink becomes unsatisfactory.

The present invention will be explained in detail below with reference to the accompanying drawing.

Figure 7:
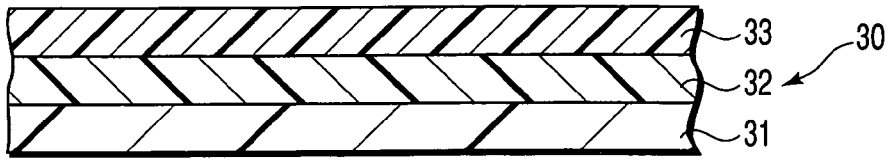
FIG. 7 is a schematic sectional view showing an example of the structure of the second heat transfer recording medium of the present invention.

FIG. 7 is a schematic sectional view showing an example of the structure of the second heat transfer recording medium of the present invention.

As shown in FIG. 7, this heat transfer recording medium 30 has a structure in which an adhesive layer 32 having the glass transition point Tg1 falling within the range Tg1≦T−80° C. and a hot-melt ink image receiving layer/adhesive layer having the second glass transition point Tg2 higher than Tg1 and falling within the range 60° C.≦Tg2≦Tg−50° C. are stacked in this order on a support sheet 31 such as a polyester film.

The adhesive layer and the hot-melt ink image receiving layer/adhesive layer can be formed by preparing resin coating solutions containing resins and preferred solvents, forming layers of these coating solutions, and drying the layers. The coating and drying are done by a method which prepares a resin mixture coating solution, forms a layer of the coating solution, and dries the layer. Examples are gravure coating, reverse coating, die coating, wire bar coating, and hot-melt coating.

After an image is formed by hot-melt ink on this heat transfer recording medium 30, the heat transfer recording medium 30 can be thermally adhered to a base such as plastic.

Figure 8:
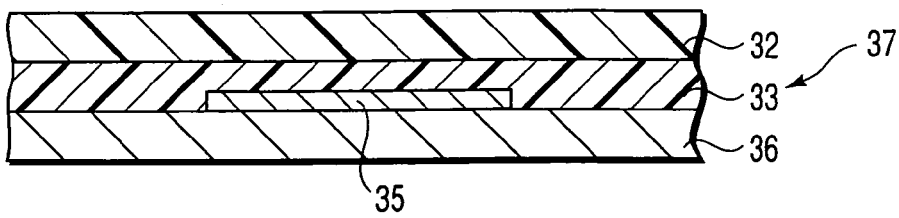
FIG. 8 is a schematic sectional view showing an example of the structure of the second printed product of the present invention.

FIG. 8 is a schematic sectional view showing an example of the structure of the second printed product of the present invention obtained using the heat transfer recording medium 30.

As shown in FIG. 8, this product 37 has a structure in which an image layer 35, a hot-melt ink image receiving layer/adhesive layer 33, and an adhesive layer 32 are stacked in this order on a base 36 such as paper.

The printed product 37 is obtained as follows. For example, the image layer 35 having an arbitrary pattern is thermally transferred onto the surface of the hot-melt ink image receiving layer/adhesive layer 33 of the heat transfer recording medium 30 by using a heat recording means such as a thermal head. Subsequently, the base 36 is placed on the image layer 35 of the heat transfer recording medium 30, and the resultant structure is passed through a heat roller capable of simultaneously applying heat and pressure, thereby entirely heating the first layer 32 and the hot-melt ink image receiving layer/adhesive layer 33 or selectively heating only a desired pattern. In this way, the whole or part of the heat transfer recording medium 30 can be thermally adhered onto the base 36. After that, an unnecessary film is removed by peeling off the support sheet 37, thereby obtaining the printed product 31 shown in FIG. 8.

To facilitate peeling of the support sheet 31 from the adhesive layer 32, a peeling layer can also be formed between the support sheet 31 and the adhesive layer 32.

Figure 9:
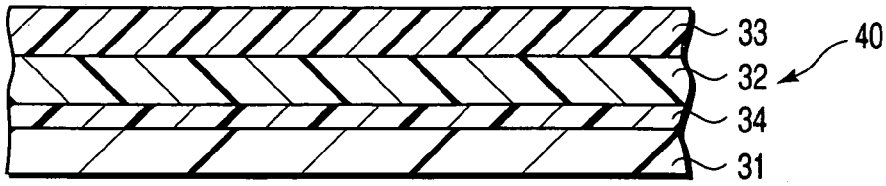
FIG. 9 is a schematic sectional view showing the structure of another example of the second heat transfer recording medium of the present invention.

FIG. 9 is a schematic sectional view showing the structure of another example of the second heat transfer recording medium of the present invention.

As shown in FIG. 9, this heat transfer recording medium 40 has the same structure as the heat transfer recording medium 20 shown in FIG. 7 except that a peeling layer 34 made of, e.g., a wax resin or ethylene-vinyl acetate copolymer resin is formed between a support sheet 31 and an adhesive layer 32. This peeling layer 34 can be formed by, e.g., gravure coating, reverse coating, die coating, wire bar coating, or hot-melt coating.

Figure 10:
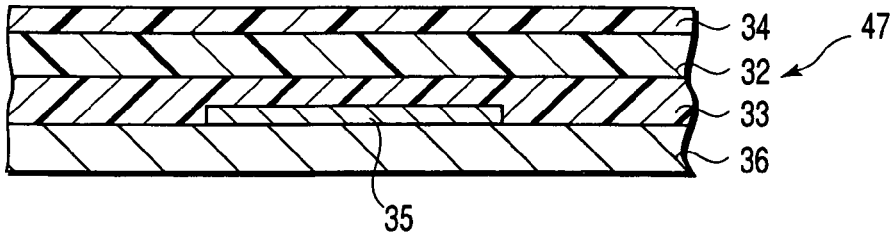
FIG. 10 is a schematic sectional view showing another example of the structure of the second printed product of the present invention.

FIG. 10 is a schematic sectional view showing another example of the structure of the second printed product of the present invention obtained using the heat transfer recording medium 40.

As shown in FIG. 10, this printed product 47 has the same structure as the printed product 37 shown in FIG. 8 except that the peeling layer 34 is formed on the adhesive layer 32.

Although the support sheet 31 is peeled off the printed product 47, this support sheet 31 can also be used as a protective layer without being peeled. Also, the support sheet 31 of the product 47 can be used as a protective layer without being peeled. In this case, it is preferable to use a heat transfer recording medium having an easy-adhesion layer instead of the peeling layer 34. An easy-adhesion layer herein mentioned is a layer which, when an adhesive layer is formed, can well adhere the support sheet 31 to the adhesive layer 32 at the dissolution or drying temperature of the solvent of the coating solution.

A resin used in the peeling layer preferably has a properly controlled adhesive force to the support member. If this adhesive force is excessively large, the support member becomes difficult to peel after thermal adhesion, and the desired first layer and hot-melt ink image receiving layer/adhesive layer can no longer be left behind on the base such as paper or plastic. If the adhesive force is too small, the support member can be easily peeled, but the undesired first layer and hot-melt ink image receiving layer/adhesive layer which are not thermally adhered also remain.

Examples of the resin having proper adhesive force appropriate as the peeling layer are a wax resin, vinyl acetate resin, ethylene-vinyl acetate copolymer resin, acrylic resin, silicone resin, polyester resin, and mixtures of these resins.

As the wax, it is possible to preferably use polyethylene wax, carnauba wax, or the like. Practical examples are Hi-Mic-2065, Hi-Mic-1045, Hi-Mic-2045, PALVAX-1230, PALVAX-1330, PALVAX-1335, PALVAX-1430, BONTEX-0011, BONTEX-0100, and BONTEX-2266 (trademarks) manufactured by NIPPON SEIRO CO., LTD.

Practical examples of the vinyl acetate resin are SAKNOHOL SN-04, SAKNOHOL SN-04S, SAKNOHOL SN-04D, SAKNOHOL SN-09A, SAKNOHOL SN-09T, SAKNOHOL SN-10, SAKNOHOL SN-10N, SAKNOHOL SN-17A, ASR CH-09, and ASR CL-13 (trademarks) manufactured by DENKI KAGAKU KOGYO K.K., Movinyl DC (trademark) manufactured by Kurarianto Polymers K.K., and Cevian A530, Cevian A700, Cevian A707, Cevian A710, Cevian A712, and Cevian A800 (trademarks) manufactured by Daiseru Kaseihin K.K.

Practical examples of the ethylene-vinyl acetate copolymer resin are EVAFLEX 45X, EVAFLEX 40, EVAFLEX 150, EVAFLEX 210, EVAFLEX 220, EVAFLEX 250, EVAFLEX 260, EVAFLEX 310, EVAFLEX 360, EVAFLEX 410, EVAFLEX 420, EVAFLEX 450, EVAFLEX 460, EVAFLEX 550, and EVAFLEX 560 (trademarks) manufactured by Du Pont-Mitsui Polychemicals Co., Ltd., Movinyl 081F (trademark) manufactured by Kurarianto Polymers K.K., EVATATE D3022, D3012, D4032, and CV8030 (trademarks) manufactured by SUMITOMO CHEMICAL CO., LTD., Hirodain 1800-5, Hirodain 1800-6, Hirodain 1800-8, Hirodain 3706, and Hirodain 4309 (trademarks) manufactured by Hirodain Kogyo K.K., and BOND CZ250 and BOND CV3105 (trademarks) manufactured by KONISHI K.K.

Practical examples of the acrylic resin are Cevian A45000, Cevian A45610, Cevian A46777, and Cevian A4635 (trademarks) manufactured by Daiseru Kaseihin K.K., Dianal BR-80, Dianal BR-83, Dianal BR-85, Dianal BR-87, Dianal BR-101, Dianal BR-102, Dianal BR-105, and Dianal BR-106 (trademarks) manufactured by Mitsubishi Rayon Co., Ltd.

A practical example of the silicone resin is Tosguard 510 (trademark) manufactured by Toshiba Silicones K.K.

Practical examples of the polyester resin are VYLON 200, VYLON 220, VYLON 240, VYLON 245, VYLON 280, VYLON 296, VYLON 530, VYLON 560, VYLON 600, VYLONAL MD1100, VYLONAL MD1200, VYLONAL MD1245, VYLONAL MD1400, and VYLONAL GX-W27 (trademarks) manufactured by TOYOBO CO., LTD., and ELITEL UE-3300, ELITEL UE-3320, ELITEL UE-3350, ELITEL UE-3370, and ELITEL UE-3380 (trademarks) manufactured by UNITIKA, LTD.

The easy-adhesion layer must have large adhesive force between the base film and both the support member and the adhesive layer. A resin satisfying this condition changes in accordance with the materials of the support member and the adhesive layer. Examples are an ethylene-vinyl acetate copolymer resin, acrylic resin, polyester resin, and mixtures of these resins.

The material of the adhesive layer is selected from those having a glass transition point lower than the thermal adhesion temperature T by 80° C. or more, preferably, 80 to 100° C., and superior in adhesion to the base, such as paper or plastic, as an object of thermal adhesion.

Examples of a resin meeting the conditions are an ethylene-vinyl acetate copolymer resin, acrylic resin, polyester resin, vinyl acetate resin, polyurethane resin, and mixtures of these resins.

As the ethylene-vinyl acetate copolymer resin, the resins used in the aforementioned peeling layer can be appropriately used.

Practical examples of the acrylic resin are Dianal BR-53, Dianal BR-64, Dianal BR-79, Dianal BR-90, Dianal BR-93, Dianal BR-101, Dianal BR-102, Dianal BR-105, Dianal BR-0.106, Dianal BR-107, Dianal BR-112, Dianal BR-115, Dianal BR-116, Dianal BR-117, and Dianal BR-118 (trademarks) manufactured by Mitsubishi Rayon Co., Ltd.

Practical examples of the polyester resin are VYLON 103, VYLON 220, VYLON 240, VYLON 245, VYLON 270, VYLON 280, VYLON 300, VYLON 500, VYLON 530, VYLON 550, VYLON 560, VYLON 600, VYLON 630, and VYLON 650 (trademarks) manufactured by TOYOBO CO., LTD., and ELITEL UE-3300, ELITEL UE-3320, ELITEL UE-3350, ELITEL UE-3370, and ELITEL UE-3380 (trademarks) manufactured by UNITIKA, LTD.

As the vinyl acetate resin, the resins used in the peeling layer described above can be properly used.

Practical examples of the polyurethane resin are Solucote 1051, Solucote 1051-1, Solucote 1054-1, and Solucote 1059 (trademarks) manufactured by Daiseru Kaseihin K.K.

The resin used in the hot-melt ink image receiving layer/adhesive layer is selected from those having a glass transition temperature which is higher than the glass transition point of the adhesive layer, which is 60° C. or more, preferably, 70° C. or more, and which is lower than the glass transition point of the hot-melt ink by 50° C. or more, preferably, 60° C. or more, and superior in adhesion to the hot-melt ink. Examples of a resin satisfying these conditions are an acrylic resin, polyester resin, phenoxy resin, and mixtures of these resins.

Practical examples of the acrylic resin are Dianal BR-50, Dianal BR-52, Dianal BR-60, Dianal BR-73, Dianal BR-75, Dianal BR-77, Dianal BR-80, Dianal BR-82, Dianal BR-83, Dianal BR-85, Dianal BR-87, Dianal BR-88, Dianal BR-95, Dianal BR-100, and Dianal BR-108, and Dianal BR-113 (trademarks) manufactured by Mitsubishi Rayon Co., Ltd.

Practical examples of the polyester resin are VYLON 290 and VYLON 296 (trademarks) manufactured by TOYOBO CO., LTD., and ELITEL UE-3600, ELITEL UE-9600, and ELITEL UE-3690 (trademarks) manufactured by UNITIKA, LTD.

Practical examples of the phenoxy resin are PKHH, PKHJ, PKHW-35, PKHW-35R, PXKS-6994, and PXKS-7000 (trademarks) manufactured by Union Carbide.

The third heat transfer recording medium of the present invention comprises a support member, and a hot-melt ink image receiving layer/adhesive layer formed on the support member and containing first and second resin components.

The first resin component has a number-average molecular weight of 16,000 or more and, has a glass transition point Tg1 of Tg−80° C. or less where the glass transition point of hot-melt ink is Tg.

The second resin component has a number-average molecular weight of 16,000 or less and a glass transition point Tg2 of Tg−50° C. or more.

The weight mixture ratio of the first resin component to the second resin component is 1:9 to 5:5.

In this hot-melt ink image receiving layer/adhesive layer, an image layer can be formed by using hot-melt ink having the glass transition point Tg.

A heat transfer recording medium in which an image layer is formed is transferred onto a base, and the support member is peeled. The result is a printed product having the base, the image layer formed on the base by the hot-melt ink having the glass transition point Tg, and the hot-melt ink image receiving layer/adhesive layer by which the image layer is received and which is adhered together with this image layer onto the base.

When the support member is not peeled, a printed product is obtained which includes the base, the image layer formed on the base by the hot-melt ink having the glass transition point Tg, the hot-melt ink image receiving layer/adhesive layer by which the image layer is received and which is adhered together with this image layer onto the base, and the support member. This support member can function as, e.g., a protective layer.

The first resin component contributes to the adhesive action, together with the second resin component, during thermal adhesion. Therefore, it is possible to assure sufficient adhesion properties which cannot be obtained by the adhesive action by the first resin component alone. The second resin component is also superior in a function of accepting hot-melt ink.

In the present invention, the hot-melt ink image receiving layer/adhesive layer containing the first and second resin components at a predetermined weight mixing ratio is used. This improves the adhesion of the hot-melt ink image receiving layer/adhesive layer to the base such as paper. In addition, since no pixel point center omission occurs, the image density is stable whenever recording is performed, so high-quality images excellent in tone reproduction can be formed.

If the number-average molecular weight of the first resin component is less than 16,000 and the glass transition point Tg1 exceeds Tg−80° C., no sufficient adhesion of the hot-melt ink image receiving layer/adhesive layer to the base can be obtained.

The number-average molecular weight of the first resin component is preferably 16,000 to 30,000. If this number-average molecular weight exceeds 30,000, sufficient adhesion strength intends to not be achieved. The glass transition point of the first resin component is preferably −20° C. to 20° C. If this glass transition point is less than −20° C., pixel shape and tone recording properties tend to be deteriorated.

If the second resin component has a number-average molecular weight exceeding 16,000 and the glass transition point Tg2 less than Tg−50° C., pixel point center omission occurs during image printing.

The number-average molecular weight of the second resin component is favorably 1,500 to 16,000. If this number-average molecular weight is less than 1,500, sufficient adhesion strength intends to not be achieved. The glass transition point of the second resin component is favorably 50 to 180° C. If this glass transition point exceeds 180° C., excessive heat amount tends to be required for thermal adhesion.

The combination of the first and second resin components can be selected from combinations of the same type or different types of resins having different glass transition points and different molecular weights, provided that these resins have predetermined molecular weights and glass transition points described above.

The present invention will be described in detail below with reference to the accompanying drawing.

Figure 11:
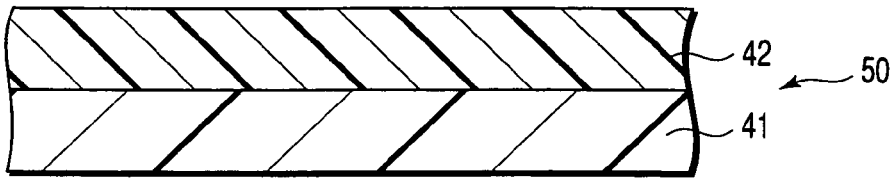
FIG. 11 is a schematic sectional view showing an example of the structure of the third heat transfer recording medium of the present invention.

FIG. 11 is a schematic sectional view showing an example of the structure of the third heat transfer recording medium of the present invention.

As shown in FIG. 11, this heat transfer recording medium 50 has a structure in which a hot-melt ink image receiving layer/adhesive layer 42 containing first and second resin components at a mixing ratio of 1:9 to 5:5 is stacked on a support sheet 41 such as a polyester film. The first resin component has a number-average molecular weight of 16,000 or more and, letting Tg be the glass transition point of hot-melt ink, has a glass transition point of Tg−80° C. or less. The second resin component has a number-average molecular weight of 16,000 or less and a glass transition point of 50° C. or more.

This hot-melt ink image receiving layer/adhesive layer 42 can be formed by preparing a resin coating solution containing the resins and a preferred solvent, forming a layer of this resin coating solution, and drying the layer. The coating and drying are done by a method which forms a layer of a coating solution and dries the layer. Examples are gravure coating, reverse coating, die coating, wire bar coating, and hot-melt coating.

After an image is formed by hot-melt ink on this heat transfer recording medium 50, the heat transfer recording medium 50 can be thermally adhered to a base such as paper or plastic.

Figure 12:
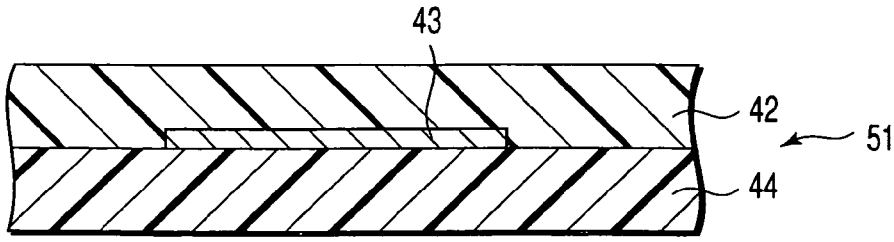
FIG. 12 is a schematic sectional view showing an example of the structure of a printed product of the present invention.

FIG. 12 is a schematic sectional view showing an example of the structure of a printed product obtained by using the heat transfer recording medium 50 shown in FIG. 11.

As shown in FIG. 12, this printed product 51 has a structure in which an image layer 43 formed by hot-melt ink and a resin layer 42 consisting of at least two components are stacked in this order on a base 44 such as paper.

The image layer 43 can be formed by placing a hot-melt ink ribbon on the surface of the hot-melt ink image receiving layer/adhesive layer 42 of the heat transfer recording medium 50, and performing heat transfer recording by using a heat recording means such as a thermal head. After the image layer 43 is formed, the paper base 44 is placed on this image layer 43, and the resultant structure is passed through, e.g., a heat roller capable of simultaneously applying heat and pressure, thereby entirely heating the hot-melt ink image receiving layer/adhesive layer 42 or selectively heating a desired pattern by using, e.g., hot stamp. In this manner, the whole or part of the hot-melt ink image receiving layer/adhesive layer 42 can be thermally adhered onto the base 44. After that, the support sheet 41 is peeled to obtain the printed product 47 shown in FIG. 12.

In this third heat transfer recording medium of the present invention, an easy-adhesion layer or a peeling layer can also be formed as an intermediate layer between the support member and the hot-melt ink image receiving layer/adhesive layer.

When the hot-melt ink image receiving layer/adhesive layer is thermally adhered onto the base and the support member formed on the hot-melt ink image receiving layer/adhesive layer is peeled off as described above, the peeling between this support member and the hot-melt ink image receiving layer/adhesive layer can be further improved by the formation of a peeling layer.

The support member can also be used as a protective layer without being peeled. When the support member is to be used as a protective layer, the adhesion between the support member and the hot-melt ink image receiving layer/adhesive layer can be further improved by the formation of an easy-adhesion layer.

Protective layers can be further formed between the support member and the hot-melt ink image receiving/adhesive layer, between the peeling layer and the hot-melt ink image receiving layer/adhesive layer, and between the support member and the easy-adhesion layer. As these protective layers, it is possible to use the protective layer used in the first heat transfer recording medium and containing mainly a resin selected from the group consisting of a polybutyral resin, phenoxy resin, and polyvinylacetal resin.

Figure 13:
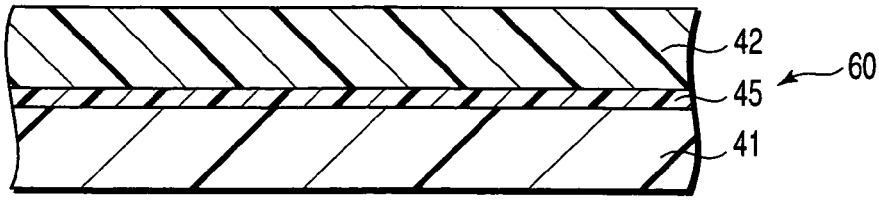
FIG. 13 is a schematic sectional view showing the structure of another example of the third heat transfer recording medium of the present invention.

FIG. 13 is a schematic sectional view showing the structure of another example of the third heat transfer recording medium of the present invention.

As shown in FIG. 13, this heat transfer recording medium 60 has the same structure as the heat transfer recording medium shown in FIG. 11, except that a peeling layer 45 made of, e.g., wax and an ethylene-vinyl acetate copolymer resin is formed between a support sheet 41 and a hot-melt ink image receiving layer/adhesive layer 42.

This peeling layer 45 can be formed by, e.g., gravure coating, reverse coating, die coating, wire bar coating, or hot-melt coating.

Figure 14:
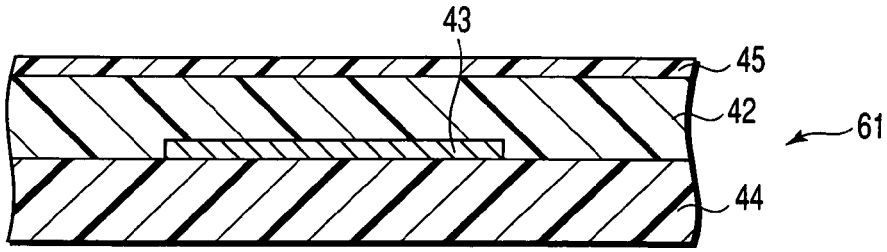
FIG. 14 is a schematic sectional view showing another example of the structure of a printed product of the present invention.

FIG. 14 is a schematic sectional view showing another example of the structure of a printed product obtained using the heat transfer recording medium 60 shown in FIG. 13.

As shown in FIG. 14, this printed product 61 has the same structure as the printed product 51 shown in FIG. 12, except that the peeling layer 45 is formed on the hot-melt ink image receiving layer/adhesive layer 42.

Referring to FIG. 14, the peeling layer 45 is formed on the hot-melt ink image receiving layer/adhesive layer 42. This peeling layer 45 can partially remain on the hot-melt ink image receiving layer/adhesive layer 42 or can be peeled off together with the support sheet 41. When the peeling layer 45 is removed, the obtained printed product has the same structure as the printed product 51 shown in FIG. 12.

Figure 15:
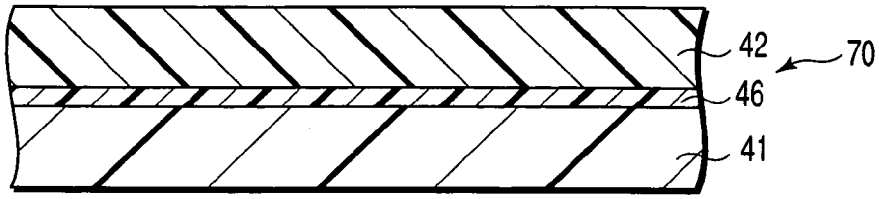
FIG. 15 is a schematic sectional view showing the structure of still another example of the heat transfer recording medium of the present invention.

FIG. 15 is a schematic sectional view showing the structure of still another example of the heat transfer recording medium of the present invention.

As shown in FIG. 15, this heat transfer recording medium 70 has the same structure as the heat transfer recording medium shown in FIG. 11, except that an easy-adhesion layer 45 made of, e.g., ethylene vinylacetate copolymer resin, acryl resin, or polyester resin is formed between a support sheet 41 and a hot-melt ink image receiving layer/adhesive layer 42.

This easy-adhesion layer 46 can be formed by, e.g., gravure coating, reverse coating, die coating, wire bar coating, or hot-melt coating.

Figure 16:
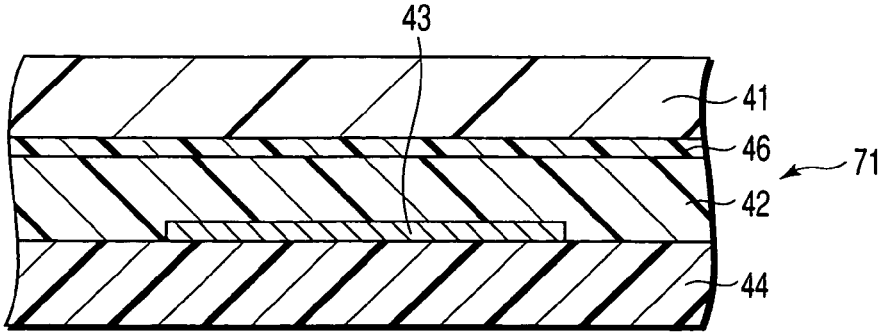
FIG. 16 is a schematic sectional view showing another example of the structure of a printed product of the present invention.

FIG. 16 is a schematic sectional view showing another example of the structure of a printed product using the heat transfer recording medium 70 shown in FIG. 15.

As shown in FIG. 16, this printed product 71 has the same structure as the printed product 61 shown in FIG. 14, except that an easy-adhesion layer 46 and a support sheet 41 are formed in this order on a hot-melt ink image receiving layer/adhesive layer 42.

A resin used in the peeling layer desirably has a properly controlled adhesive force to the support member. If this adhesive force is excessively large, the support member can become difficult to peel after thermal adhesion. If the adhesive force is too small, the support member can be easily peeled, but an undesired resin layer which is not thermally adhered often remains on the hot-melt ink image receiving layer/adhesive layer.

Examples of the resin having proper adhesive force appropriate as the peeling layer are wax, vinyl acetate resin, ethylene-vinyl acetate copolymer resin, acrylic resin, silicone resin, polyester resin, and mixtures of these resins.

As the wax, it is possible to preferably use polyethylene wax, carnauba wax, or the like. Practical examples are Hi-Mic-2065, Hi-Mic-1045, Hi-Mic-2045, PALVAX-1230, PALVAX-1330, PALVAX-1335, PALVAX-1430, BONTEX-0011, BONTEX-0100, and BONTEX-2266 (trademarks) manufactured by NIPPON SEIRO CO., LTD.

Practical examples of the vinyl acetate resin are SAKNOHOL SN-04, SAKNOHOL SN-04S, SAKNOHOL SN-04D, SAKNOHOL SN-09A, SAKNOHOL SN-09T, SAKNOHOL SN-10, SAKNOHOL SN-10N, SAKNOHOL SN-17A, ASR CH-09, and ASR CL-13 (trademarks) manufactured by DENKI KAGAKU KOGYO K.K., Movinyl DC (trademark) manufactured by Kurarianto Polymers K.K., and Cevian A530, Cevian A700, Cevian A707, Cevian A710, Cevian A712, and Cevian A800 (trademarks) manufactured by Daiseru Kaseihin K.K.

Practical examples of the ethylene-vinyl acetate copolymer resin are EVAFLEX 45X, EVAFLEX 40, EVAFLEX 150, EVAFLEX 210, EVAFLEX 220, EVAFLEX 250, EVAFLEX 260, EVAFLEX 310, EVAFLEX 360, EVAFLEX 410, EVAFLEX 420, EVAFLEX 450, EVAFLEX 460, EVAFLEX 550, and EVAFLEX 560 (trademarks) manufactured by Du Pont-Mitsui Polychemicals Co., Ltd., Movinyl 081F (trademark) manufactured by Kurarianto Polymers K.K., EVATATE D3022, D3012, D4032, and CV8030 (trademarks) manufactured by SUMITOMO CHEMICAL CO., LTD., Hirodain 1800-5, Hirodain 1800-6, Hirodain 1800-8, Hirodain 3706, and Hirodain 4309 (trademarks) manufactured by Hirodain Kogyo K.K., and BOND CZ250 and BOND CV3105 (trademarks) manufactured by KONISHI K.K.

Practical examples of the acrylic resin are Cevian A45000, Cevian A45610, Cevian A46777, and Cevian A4635 (trademarks) manufactured by Daiseru Kaseihin K.K., and Dianal BR-80, Dianal BR-83, Dianal BR-85, Dianal BR-87, Dianal BR-101, Dianal BR-102, Dianal BR-105, and Dianal BR-106 (trademarks) manufactured by Mitsubishi Rayon Co., Ltd.

A practical example of the silicone resin is Tosguard 510 (trademark) manufactured by Toshiba Silicones K.K.

Practical examples of the polyester resin are VYLON 200, VYLON 220, VYLON 240, VYLON 245, VYLON 280, VYLON 296, VYLON 530, VYLON 560, VYLON 600, VYLONAL MD1100, VYLONAL MD1200, VYLONAL MD1245, VYLONAL MD1400, and VYLONAL GX-W27 (trademarks) manufactured by TOYOBO CO., LTD., and ELITEL UE-3300, ELITEL UE-3320, ELITEL UE-3350, ELITEL UE-3370, and ELITEL UE-3380 (trademarks) manufactured by UNITIKA, LTD.

The easy-adhesion layer must have large adhesive force between the base film and both the support member and the resin layer. A resin satisfying this requirement is selected in accordance with the materials of the support member and hot-melt ink image receiving layer/adhesive layer. Examples are an ethylene-vinyl acetate copolymer resin, acrylic resin, polyester resin, and mixtures of these resins.

Practical examples of the ethylene-vinyl acetate copolymer resin are EVAFLEX 45X, EVAFLEX 40, EVAFLEX 150, EVAFLEX 210, EVAFLEX 220, EVAFLEX 250, EVAFLEX 260, EVAFLEX 310, EVAFLEX 360, EVAFLEX 410, EVAFLEX 420, EVAFLEX 450, EVAFLEX 460, EVAFLEX 550, and EVAFLEX 560 (trademarks) manufactured by Du Pont-Mitsui Polychemicals Co., Ltd., Movinyl 081F (trademark) manufactured by Kurarianto Polymers K.K., EVATATE D3022, D3012, D4032, and CV8030 (trademarks) manufactured by SUMITOMO CHEMICAL CO., LTD., Hirodain 1800-5, Hirodain 1800-6, Hirodain 1800-8, Hirodain 3706, and Hirodain 4309 (trademarks) manufactured by Hirodain Kogyo K.K., and BOND CZ250 and BOND CV3105 (trademarks) manufactured by KONISHI K.K.

Practical examples of the acryl resin are Dianal BR-53, Dianal BR-64, Dianal BR-77, Dianal BR-79, Dianal BR-90, Dianal BR-93, Dianal BR-101, Dianal BR-102, Dianal BR-105, Dianal BR-106, Dianal BR-107, Dianal BR-112, Dianal BR-115, Dianal BR-116, Dianal BR-117, Dianal BR-118, (trademarks) manufactured by Mitsubishi Rayon Co., Ltd.

Practical examples of the polyester resin are VYLON 103, VYLON 220, VYLON 240, VYLON 245, VYLON 270, VYLON 280, VYLON 300, VYLON 500, VYLON 530, VYLON 550, VYLON 560, VYLON 600, VYLON 630, VYLON 650 (trademarks) manufactured by TOYOBO CO., LTD., ELITEL UE-3300, ELITEL UE-3320, ELITEL UE-3350, ELITEL UE-3370, ELITEL UE-3380 (trademarks) manufactured by UNITIKA, LTD.

The first and second resin components of the hot-melt ink image receiving layer/adhesive layer used in the present invention are preferably made of at least one of a polyester resin and acrylic resin.

More preferably, the combination of the first and second resin components is an acrylic resin and polyester resin, or a polyester resin and polyester resin.

Particularly preferably, the combination is polyester resin and polyester resin.

More particularly preferably, the combination is VYLON 300 and ELITEL UE-3350.

Examples of the first resin component used in the hot-melt ink image receiving layer/adhesive layer are an acrylic resin and polyester resin.

Practical examples of the acrylic resin are Dianal BR-102 and Dianal BR-112 (trademarks) manufactured by Mitsubishi Rayon Co., Ltd.

Practical examples of the polyester resin are VYLON 300, VYLON 500, VYLON 530, VYLON 550, VYLON 560, VYLON 630, VYLON 650, VYLON GK130, VYLON GK330, VYLON BX1001, VYLON GM400, VYLON GM460, VYLON GM470, VYLON GM480, VYLON GM900, VYLON GM913, VYLON GM920, VYLON GM925, VYLON GM990, VYLON GM995, VYLON GA1300, VYLON GA3200, VYLON GA3410, VYLON GA5300, VYLON GA5410, VYLON GA6300, VYLON GA6400, VYLON 30P, VYLON UR2300, VYLON UR3200, VYLON UR3210, VYLON UR8700, VYLON UR9500, VYLONAL MD1930, and VYLONAL MD1985 (trademarks) manufactured by TOYOBO CO., LTD., and ELITEL UE-3220, ELITEL UE-3223, ELITEL UE-3230, ELITEL UE-3231, ELITEL UE-3400, ELITEL UE-3700, and ELITEL UE-3800 (trademarks) manufactured by UNITIKA, LTD.

Examples of the resin used as the second resin component are stylene-acryl copolymer resin and a polyester resin.

Practical examples of the polyester resin are VYLON 220, VYLON 240, VYLON 296, VYLON GK250, VYLONAL MD1200, VYLONAL MD1220, VYLONAL MD1250, and VYLONAL MD1500 (trademarks) manufactured by TOYOBO CO., LTD., and ELITEL UE-9200, ELITEL UE-3690, ELITEL UE-3370, ELITEL UE-3380, ELITEL UE-3350, and ELITEL UE-3300 (trademarks) manufactured by UNITIKA, LTD.

Practical examples of stylene-acryl copolymer resin are S-lecP SE-0020, S-lecP SE-0040, S-lecP SE-0070, S-lecP SE-1010, S-lecP SE-1035 (trademarks) manufactured by Sekisui Chemical Co., Ltd.

EXAMPLES

Examples of Heat Transfer Recording Medium Having Protective Layer Containing Mainly Polyvinylbutyral Resin

Example 1

As a support member, a 25-μm thick transparent polyester film (trademark: Diafoil S100, manufactured by Mitsubishi Polyester Film Corp.) was prepared. One surface of this transparent polyester film was coated with a protective layer coating solution having the following composition by using a gravure coater, such that the dried film thickness was 1 μm. After that, the obtained coating film was heated at 120° C. for 2 min and dried to form a protective layer.

| Composition of protective layer coating solution 1 | |
|---|---|
| Methylethylketone | 92 parts by weight |
| Water | 4 parts by weight |
| Polyvinylbutyral resin S-lec BL-3 manufactured by Sekisui Chemical Co., Ltd. | 4 parts by weight |

Subsequently, the obtained protective layer was coated with a hot-melt ink image receiving layer coating solution having the following composition by using a gravure coater, such that the dried film thickness was 6 μm. The obtained coating film was heated at 120° C. for 2 min and dried to form a hot-melt ink image receiving layer, thereby obtaining a hot-melt ink heat transfer recording medium.

| Composition of hot-melt ink image receiving layer coating solution | |
|---|---|
| Methylethylketone | 40 parts by weight |
| Toluene | 40 parts by weight |
| VYLON 240 manufactured by TOYOBO CO., LTD. | 20 parts by weight |

On the image receiving layer of the obtained heat transfer recording medium, a color image was recorded by a 300-dpi thermal head by using a hot-melt ink ribbon. In addition, a card base available from TORAY INDUSTRIES, INC. was brought into contact with this image receiving layer on which the color image was formed, and thermally adhered by heat and pressure by using Laminator LPD2306 City manufactured by Fujipra K.K. The roller temperature and the roller rotating speed of this laminator were adjusted to 180° C. and 1 m/min, respectively. After that, the support member was peeled off to obtain an ID card.

The obtained ID card was tested and evaluated as follows for the reproducibility of each pixel point and the fusing properties to a vinyl chloride sheet.

Pixel Point Reproducibility Test

The reproducibility of a pixel point was tested by visually observing, using a ×25 test glass, the shape of each pixel point of the color image of the obtained ID card. When the variations in pixel point shape were small, the evaluation was ○; when the variations were large, the evaluation was x.

Test of Fusing Properties to Vinyl Chloride

The fusing properties to vinyl chloride were tested as follows. Altron All-Season #3300 vinyl chloride sheet manufactured by Mitsubishi Kagaku MKV K.K. was overlapped on the obtained ID card, and a load of 15 g/cm$^2$ was applied. After the resultant structure was stored in a constant temperature bath adjusted at 75° C. for 24 hr, fusion to the vinyl chloride sheet was observed.

If the vinyl chloride sheet and the ID card were fused, the evaluation was x; if they were not fused, the evaluation was ○.

The result of the pixel point reproducibility test was good.

Also, no fusion to vinyl chloride occurred, so the fusing properties had no problem.

The above evaluation results are shown in Table 1 to be presented later.

Example 2

An ID card was obtained following the same procedures as in Example 1, except that a protective layer coating solution 2 containing S-lec BL-S manufactured by Sekisui Chemical Co., Ltd. instead of S-lec BL-3 manufactured by Sekisui Chemical Co., Ltd. as a polyvinylbutyral resin was used.

The obtained ID card was tested and evaluated for the reproducibility of each pixel point and the fusing properties to a vinyl chloride sheet, following the same procedures as in Example 1.

The result of the pixel point reproducibility test was good.

Also, no fusion to vinyl chloride occurred, so the fusing properties had no problem.

The above evaluation results are shown in Table 1.

Comparative Examples 1–4

Resin layers were formed such that the dried film thickness was 1 μm following the same procedures as in Example 1, except that protective layer coating solutions 7 to 10 having the following compositions were used.

| Compositions of protective layer coating solutions 9 to 12 | |
|---|---|
| Methylethylketone | 48 parts by weight |
| Toluene | 48 parts by weight |
| Various resins described in Table 1 | 4 parts by weight |

Subsequently, image receiving layers were formed on the obtained protective layers following the same procedures as in Example 1, thereby obtaining hot-melt ink heat transfer recording media.

By using the obtained heat transfer recording media, ID cards were formed in the same manner as in Example 1.

The obtained ID cards were tested and evaluated following the same procedures as in Example 1. Consequently, the results of the pixel point reproducibility test were good, but fusion to vinyl chloride occurred.

The results are shown in Table 1.

Examples 3 & 4

A sublimating ink image receiving layer coating solution containing VYLON 200 for a sublimating ink image receiving layer manufactured by TOYOBO CO., LTD., instead of VYLON 240 for a hot-melt ink image receiving layer, was prepared. By using this coating solution, sublimating ink image receiving layers were formed on protective layers following the same procedures as in Examples 1 and 2, thereby obtaining sublimating ink heat transfer recording media.

Color images were formed on the obtained heat transfer recording media following the same procedures as in Example 1, except that a sublimating ink ribbon was used instead of a hot-melt ink ribbon, thereby obtaining ID cards.

The obtained ID cards were subjected to a test of fusing properties to vinyl chloride in the same manner as in Example 1. Consequently, no fusion occurred.

Also, the images of the sublimating ink were subjected to a dye diffusion test as follows.

Sublimating Ink Dye Diffusion Test

Sublimating ink dye diffusion was tested by visually observing dye diffusion in the color images of the obtained ID cards by using a ×25 test glass. If the image remained unchanged from that before the test, the evaluation was ○; if the image was blurred by dye diffusion, the evaluation was x.

No dye diffusion was found in the obtained ID cards.

The results are shown in Table 2 to be presented later.

Comparative Examples 5–8

Sublimating ink image receiving layers were formed following the same procedures as in Example 3 by using protective layer coating solutions similar to those in Comparative Examples 1 to 4, thereby obtaining sublimating ink heat transfer recording media.

By using the obtained heat transfer recording media, ID cards were obtained following the same procedures as in Example 3.

The obtained ID cards were tested and evaluated in the same manner as in Example 3. Consequently, fusion to vinyl chloride occurred, and dye diffusion was found.

The results are shown in Table 2.

Examples of Heat Transfer Recording Medium Having Protective Layer Containing Mainly Phenoxy Resin Example 5

An ID card was obtained following the same procedures as in Example 1, except that a protective layer coating solution 3 having the following composition was used instead of the protective layer coating solution 1.

The obtained ID card was tested and evaluated for the reproducibility of each pixel point and the fusing properties to a vinyl chloride sheet, following the same procedures as in Example 1.

The result of the pixel point reproducibility test was good.

Also, no fusion to vinyl chloride occurred, so the fusing properties had no problem.

The results are shown in Table 3 to be presented later.

Example 6

An ID card was obtained following the same procedures as in Example 1, except that a protective layer coating solution 2 containing PKHC available from Union Carbide instead of PKHH available from Union Carbide as a phenoxy resin was used.

The obtained ID card was tested and evaluated for the reproducibility of each pixel point and the fusing properties to a vinyl chloride sheet, following the same procedures as in Example 1.

The result of the pixel point reproducibility test was good.

Also, no fusion to vinyl chloride occurred, so the fusing properties had no problem.

The results are shown in Table 3.

Examples 7 & 8

Sublimating ink heat transfer recording media were obtained following the same procedures as in Examples 5 and 6, except that sublimating ink image receiving layers were formed using a sublimating ink image receiving layer coating solution similar to that in Example 3.

Color images were formed following the same procedures as in Example 3 by using the obtained sublimating ink heat transfer recording media, thereby obtaining ID cards.

The obtained ID cards were tested for the fusing properties to vinyl chloride in the same manner as in Example 1. As a consequence, no fusion occurred.

Also, the images of sublimating ink were subjected to the same dye diffusion test as in Example 3, with the result that no blur by dye diffusion was found.

The obtained results are shown in Table 4 to be presented later.

Examples of Heat Transfer Recording Medium Having Protective Layer Containing Mainly Polyvinylacetal Resin Example 9

An ID card was obtained following the same procedures as in Example 1, except that a protective layer coating solution 5 having the following composition was used instead of the protective layer coating solution 1.

| Composition of protective layer coating solution 5 | |
|---|---|
| Methylethylketone | 92 parts by weight |
| Water | 4 parts by weight |
| Polyvinylacetal resin S-lec KS-1 manufactured by Sekisui Chemical Co., Ltd. | 4 parts by weight |

The obtained ID card was tested and evaluated for the reproducibility of each pixel point and the fusing properties to a vinyl chloride sheet, following the same procedures as in Example 1.

The result of the pixel point reproducibility test was good.

Also, no fusion to vinyl chloride occurred, so the fusing properties had no problem.

The results are shown in Table 5 to be presented later.

Example 10

An ID card was obtained following the same procedures as in Example 1, except that a protective layer coating solution 6 containing S-lec KX-1 manufactured by Sekisui Chemical Co., Ltd. instead of S-lec KS-1 manufactured by Sekisui Chemical Co., Ltd. as a polyvinylacetal resin was used.

The obtained ID card was tested and evaluated for the reproducibility of each pixel point and the fusing properties to a vinyl chloride sheet, following the same procedures as in Example 1.

The result of the pixel point reproducibility test was good.

Also, no fusion to vinyl chloride occurred, so the fusing properties had no problem.

The obtained evaluation results are shown in Table 5.

Examples 11 & 12

Sublimating ink image receiving layers were formed following the same procedures as in Example 3 by using protective layer coating solutions similar to those used in Examples 9 and 10, thereby obtaining sublimating ink heat transfer recording media.

ID cards were obtained following the same procedures as in Example 3 by using the obtained heat transfer recording media.

The obtained ID cards were tested for the fusing properties to vinyl chloride in the same manner as in Example 1. As a consequence, no fusion occurred.

Also, images of sublimating ink were subjected to the same dye diffusion test as in Example 3, with the result that no blur by dye diffusion was found.

The obtained results are shown in Table 6 below.

TABLE 1

| | | Protective layer resin | Pixel point reproducibility | Fusing properties to vinyl chloride |
|---|---|---|---|---|
| Example | 1 | S-lec BL-3 (polyvinylbutyral resin) manufactured by Sekisui Chemical Co., Ltd. | ○ | ○ |
| | 2 | S-lec BL-S (polyvinylbutyral resin) manufactured by Sekisui Chemical Co., Ltd. | ○ | ○ |
| Comparative Example | 1 | VYLON 290 (polyester resin) manufactured by TOYOBO CO., LTD. | ○ | X |
| | 2 | ELITEL UE-3320 (polyester resin) manufactured by UNITIKA, LTD. | ○ | X |
| | 3 | Dianal BR-87 (acrylic resin) manufactured by Mitsubishi Rayon Co., Ltd. | ○ | X |
| | 4 | SAKNOHOL SN-09T (vinyl acetate resin) manufactured by DENKI KAGAKU KOGYO K.K. | ○ | X |

TABLE 2

| | | Protective layer resin | Fusing properties to vinyl chloride | Dye diffusion |
|---|---|---|---|---|
| Example | 3 | S-lec BL-3 (polyvinylbutyral resin) manufactured by Sekisui Chemical Co., Ltd. | ○ | Not found |
| | 4 | S-lec BL-S (polyvinylbutyral resin) manufactured by Sekisui Chemical Co., Ltd. | ○ | Not found |
| Comparative Example | 5 | VYLON 290 (polyester resin) manufactured by TOYOBO CO., LTD. | X | Found |
| | 6 | ELITEL UE-3320 (polyester resin) manufactured by UNITIKA, LTD. | X | Found |
| | 7 | Dianal BR-87 (acrylic resin) manufactured by Mitsubishi Rayon Co., Ltd. | X | Found |
| | 8 | SAKNOHOL SN-09T (vinyl acetate resin) manufactured by DENKI KAGAKU KOGYO K.K. | X | Found |

TABLE 3

| | | Protective layer resin | Pixel point reproducibility | Fusing properties to vinyl chloride |
|---|---|---|---|---|
| Example | 5 | PKHH (phenoxy resin) manufactured by Union Carbide | ○ | ○ |
| | 6 | PKHC (phenoxy resin) manufactured by Union Carbide | ○ | ○ |

TABLE 4

| | | Protective layer resin | Fusing properties to vinyl chloride | Dye diffusion |
|---|---|---|---|---|
| Example | 7 | PKHH (phenoxy resin) manufactured by Union Carbide | ○ | Not found |
| | 8 | PKHC (phenoxy | ○ | Not found |

TABLE 4-continued

| | | Protective layer resin | Fusing properties to vinyl chloride | Dye diffusion |
|---|---|---|---|---|
| | | resin) manufactured by Union Carbide | | |

TABLE 5

| | | Protective layer resin | Pixel point reproducibility | Fusing properties to vinyl chloride |
|---|---|---|---|---|
| Example | 9 | S-lec KS-1 (polyvinylacetal resin) manufactured by | ○ | ○ |

TABLE 5-continued

| | Protective layer resin | Pixel point reproducibility | Fusing properties to vinyl chloride |
|---|---|---|---|
| | Sekisui Chemical Co., Ltd. | | |
| 10 | S-lec KX-1 (polyvinylacetal resin) manufactured by Sekisui Chemical Co., Ltd. | ○ | ○ |

TABLE 6

| | | Protective layer resin | Fusing properties to vinyl chloride | Dye diffusion |
|---|---|---|---|---|
| Example | 11 | S-lec KS-1 (polyvinylacetal resin) manufactured by Sekisui Chemical Co., Ltd. | ○ | Not found |
| | 12 | S-lec KX-1 (polyvinylacetal resin) manufactured by Sekisui Chemical Co., Ltd. | ○ | Not found |

As is apparent from Table 1 above, when a printed product was formed by using the hot-melt ink heat transfer recording medium having a protective layer containing a polyvinylbutyral resin according to the present invention, the pixel point reproducibility was fine, and no fusion to vinyl chloride occurred.

As is apparent from Table 2 above, when a printed product was formed by using the sublimating ink heat transfer recording medium having a protective layer containing a polyvinylbutyral resin according to the present invention, neither dye diffusion nor fusion to vinyl chloride occurred.

As shown in Table 3 above, when a printed product was formed by using the hot-melt ink heat transfer recording medium having a protective layer containing a phenoxy resin according to the present invention, the pixel point reproducibility was fine, and no fusion to vinyl chloride occurred.

As can be seen from Table 4 above, when a printed product was formed by using the sublimating ink heat transfer recording medium having a protective layer containing a phenoxy resin according to the present invention, neither dye diffusion nor fusion to vinyl chloride occurred.

As is evident from Table 5 above, when a printed product was formed by using the hot-melt ink heat transfer recording medium having a protective layer containing a polyvinylacetal resin according to the present invention, the pixel point reproducibility was fine, and no fusion to vinyl chloride occurred.

As shown in Table 6 above, when a printed product was formed by using the sublimating ink heat transfer recording medium having a protective layer containing a polyvinylacetal resin according to the present invention, neither dye diffusion nor fusion to vinyl chloride occurred.

As is apparent from Comparative Examples 1 to 4 shown in Table 1 above, however, when a printed product was formed by using the hot-melt ink heat transfer recording medium having a protective layer formed using a resin other than a polyvinylbutyral resin, phenoxy resin, and polyvinylacetal resin, fusion to vinyl chloride occurred to make long-term storage impossible.

Also, as is evident from Comparative Examples 5 to 8 shown in Table 2 above, when a printed product was formed by using the sublimating ink heat transfer recording medium having a protective layer formed using a resin other than a polyvinylbutyral resin, phenoxy resin, and polyvinylacetal resin, fusion to vinyl chloride and dye diffusion occurred to make long-term storage impossible.

As can be seen from Examples 1 to 12 and Comparative Examples 1 to 8 described above, the present invention can provide, by using a heat transfer recording medium having a protective layer containing mainly a resin selected from the group consisting of a polyvinylbutyral resin, phenoxy resin, and polyvinylacetal resin, a printed product which, even when stored as it is overlayed on a resin containing a plastic material such as vinyl chloride, causes neither fusion to the resin nor deterioration of an image and hence can be stably stored for long time periods.

Examples 13–22 & Comparative Examples 9–13

Hot-melt ink heat transfer recording media and ID cards were obtained following the same procedures as in Example 1, except that first and second components were mixed at weight ratios shown in Table 7 below instead of 4 parts by weight of S-lec BL-3.

The obtained ID cards were tested and evaluated for the reproducibility of each pixel point and the fusing properties to a vinyl chloride sheet following the same procedures as in Example 1.

The obtained results are shown in Table 7 below.

TABLE 7

| | | Protective layer resin | | Weight | Fusing properties to vinyl |
|---|---|---|---|---|---|
| | | First component | Second component | ratio | chloride |
| Example | 13 | PKHH (phenoxy resin) manufactured by Union Carbide | VYLON 290 (polyester resin) manufactured by TOYOBO CO., LTD. | 8:2 | ○ |
| | 14 | PKHH (phenoxy resin) manufactured by Union Carbide | VYLON 290 (polyester resin) manufactured by TOYOBO CO., LTD. | 5:5 | ○ |
| | 15 | PKHH (phenoxy resin) manufactured by Union Carbide | Dianal BR-87 (acrylic resin) manufactured by Mitsubishi Rayon Co., Ltd. | 8:2 | ○ |

TABLE 7-continued

| | | Protective layer resin | | Weight | Fusing properties to vinyl |
|---|---|---|---|---|---|
| | | First component | Second component | ratio | chloride |
| | 16 | PKHH (phenoxy resin) manufactured by Union Carbide | Dianal BR-87 (acrylic resin) manufactured by Mitsubishi Rayon Co., Ltd. | 5:5 | ○ |
| | 17 | PKHH (phenoxy resin) manufactured by Union Carbide | SAKNOHOL SN-09T (vinyl acetate resin) manufactured by DENKI KAGAKU KOGYO K.K. | 8:2 | ○ |
| | 18 | PKHH (phenoxy resin) manufactured by Union Carbide | SAKNOHOL SN-09T (vinyl acetate resin) manufactured by DENKI KAGAKU KOGYO K.K. | 5:5 | ○ |
| | 19 | S-lec BL-3 (polyvinylbutyral resin) manufactured by Sekisui Chemical Co., Ltd. | VYLON 290 (polyester resin) manufactured by TOYOBO CO., LTD. | 8:2 | ○ |
| | 20 | S-lec BL-3 (polyvinylbutyral resin) manufactured by Sekisui Chemical Co., Ltd. | VYLON 290 (polyester resin) manufactured by TOYOBO CO., LTD. | 5:5 | ○ |
| | 21 | S-lec KS-1 (polyvinylacetal resin) manufactured by Sekisui Chemical Co., Ltd. | VYLON 290 (polyester resin) manufactured by TOYOBO CO., LTD. | 8:2 | ○ |
| | 22 | S-lec KS-1 (polyvinylacetal resin) manufactured by Sekisui Chemical Co., Ltd. | VYLON 290 (polyester resin) manufactured by TOYOBO CO., LTD. | 5:5 | ○ |
| Comparative Example | 9 | PKHH (phenoxy resin) manufactured by Union Carbide | VYLON 290 (polyester resin) manufactured by TOYOBO CO., LTD. | 4:6 | X |
| | 10 | PKHH (phenoxy resin) manufactured by Union Carbide | Dianal BR-87 (acrylic resin) manufactured by Mitsubishi Rayon Co., Ltd. | 4:6 | X |
| | 11 | PKHH (phenoxy resin) manufactured by Union Carbide | SAKNOHOL SN-09T (vinyl acetate resin) manufactured by DENKI KAGAKU KOGYO K.K. | 4:6 | X |
| | 12 | S-lec BL-3 (polyvinylbutyral resin) manufactured by Sekisui Chemical Co., Ltd. | VYLON 290 (polyester resin) manufactured by TOYOBO CO., LTD. | 4:6 | X |
| | 13 | S-lec KS-1 (polyvinylacetal resin) manufactured by Sekisui Chemical Co., Ltd. | VYLON 290 (polyester resin) manufactured by TOYOBO CO., LTD. | 4:6 | X |

As shown in Table 7, a protective layer containing 50 wt % or 80 wt % of a polyvinylbutyral resin, phenoxy resin, or polyvinylacetal resin could well prevent fusion to a plastic material. However, if the content of the resin was less than 50 wt %, e.g., 40 wt %, the fusion could not be well prevented.

Examples of Heat Transfer Recording Medium Having Image Receiving Layer and Adhesive Layer Examples 23 & 24

A 25-μm thick transparent polyester film (trademark: Lumirror Q27, manufactured by TORAY INDUSTRIES, INC.) subjected to an easy adhesion imparting process was prepared. One surface of this transparent polyester film was coated with an adhesive layer coating solution having the following composition by using a gravure coater, such that the dried film thickness was 6 μm. The obtained coating film was heated and dried at 120° C. for 2 min to form an adhesive layer having a glass transition temperature lower than the thermal adhesion temperature (in this example, about 150° C.) by 80° C. or more.

| Composition of adhesive layer coating solution | |
|---|---|
| Methylethylketone | 40 parts by weight |
| Toluene | 40 parts by weight |

-continued

| Composition of adhesive layer coating solution | |
|---|---|
| One of various resins described in Table 8 to be presented later | 20 parts by weight |

Subsequently, the adhesive layer was coated with a hot-melt ink image receiving layer/adhesive layer coating solution having the following composition by using a gravure coater, such that the dried film thickness was 0.2 μm. The obtained coating film was heated and dried at 120° C. for 2 min to form a hot-melt ink image receiving layer/adhesive layer having a glass transition point equal to or higher than 60° C. and lower than the glass transition point of hot-melt ink by 50° C. or more, thereby obtaining a heat transfer recording medium.

| Composition of hot-melt ink image receiving layer/adhesive layer coating solution | |
|---|---|
| Methylethylketone | 48 parts by weight |
| Toluene | 48 parts by weight |
| One of various resins described in Table 8 | 4 parts by weight |

On the hot-melt ink image receiving layer/adhesive layer of the heat transfer recording medium obtained as above, a color image was recorded by a 600-dpi thermal head by using a commercially available hot-melt ink ribbon.

After that, this heat transfer recording medium was thermally adhered to commercially available PPC paper by using Laminator LPD2306 City manufactured by Fujipra K.K., thereby forming a final image on this PPC paper. The roller temperature and the roller rotating speed of this laminator were adjusted to 180° C. and 1 m/min, respectively.

The pixel point shape, recording image density reproducibility, and adhesion strength of the obtained image were evaluated.

Evaluation of Pixel Point Shape

The pixel point shape of the obtained image was observed with a stereomicroscope, thereby checking the presence/absence of pixel point center omission. If no center omission was found, the evaluation was ○; if center omission was found, the evaluation was x.

The results are shown in Table 8.

Evaluation of Adhesion Strength

After thermal adhesion, a tape peeling test using an adhesive tape was conducted on a heat transfer recording medium from which the support member was to be peeled, and a peeling test for forcedly peeling off the support member was conducted on a heat transfer recording medium from which the support member was not to be peeled, thereby measuring the adhesion strength. In the tape peeling test, the evaluation was ○ if no resin layer was sticking to the peeled tape. In the peeling test, the evaluation was ○ if the base (paper) was not sticking to the peeled film. The results are shown in Table 8.

Comparative Examples 14–17

Adhesive layers were formed such that the dried film thickness was 6 μm following the same procedures as in Example 23, except that coating solutions having the following compositions were used.

| Adhesive layer coating solutions | |
|---|---|
| Methylethylketone | 40 parts by weight |
| Toluene | 40 parts by weight |
| Various resins described in Table 7 | 20 parts by weight |

Subsequently, hot-melt ink image receiving layers/adhesive layers were formed such that the dried film thickness was 0.2 μm following the same procedures as in Example 23, except that coating solutions having the following compositions were used.

| Hot-melt ink image receiving layer/adhesive layer coating solutions | |
|---|---|
| Methylethylketone | 48 parts by weight |
| Toluene | 48 parts by weight |
| Various resins described in Table 7 | 4 parts by weight |

Examples 25 & 26, & Comparative Examples 18–21

One surface of a 25-μm thick transparent polyester film (trademark: Lumirror S10, manufactured by TORAY INDUSTRIES, INC.) was coated with a resin solution having the following composition by using a gravure coater, such that the dried film thickness was 1 μm. The coating film was heated and dried at 120° C. for 2 min to form a peeling layer.

| Composition of peeling layer coating solution | |
|---|---|
| Methylethylketone | 35 parts by weight |
| Toluene | 35 parts by weight |
| Vinyl acetate resin (trademark: Cevian A700, manufactured by Daiseru Kaseihin K.K.) | 20 parts by weight |
| Polyester resin (trademark: VYLON 220, manufactured by TOYOBO CO., LTD.) | 10 parts by weight |

Subsequently, on this peeling layer, an adhesive layer and a hot-melt ink image receiving layer/adhesive layer were formed following the same procedures as in each of Examples 23 and 24 and Comparative Examples 14 to 17, thereby obtaining heat transfer recording media.

By using the obtained heat transfer recording media, final images were formed on PPC paper in the same manner as in Example 23.

The pixel point shape, recorded image density reproducibility, and adhesion strength of each obtained image were evaluated in the same manner as in Example 23.

The results are shown in Table 9 below.

TABLE 9

| | | Second layer (peeling layer side) | Third layer (surface side) | Pixel point shape | Adhesion strength |
|---|---|---|---|---|---|
| Example | 25 | VYLON 220 (TG = 53° C.) manufactured by TOYOBO CO., LTD. | VYLON 290 (TG = 72° C.) manufactured by TOYOBO CO., LTD. | ○ | ○ |
| | 26 | ELITEL UE-3320 (TG = 40° C.) manufactured by UNITIKA, LTD. | PKHC (TG = 100° C.) manufactured by Union Carbide | ○ | ○ |
| Comparative Example | 18 | VYLON 290 (TG = 72° C.) manufactured by TOYOBO CO., LTD. | VYLON 220 (TG = 53° C.) manufactured by TOYOBO CO., LTD. | X | ○ |
| | 19 | PKHC (TG = 100° C.) manufactured by Union Carbide | ELITEL UE-3320 (TG = 40° C.) manufactured by UNITIKA, LTD. | X | ○ |

TABLE 9-continued

| | Second layer (peeling layer side) | Third layer (surface side) | Pixel point shape | Adhesion strength |
|---|---|---|---|---|
| 20 | VYLON 290 (TG = 72° C.) manufactured by TOYOBO CO., LTD. | None | ○ | X |
| 21 | ELITEL UE-3320 (TG = 40° C.) manufactured by UNITIKA, LTD. | None | X | ○ |

As described above, the second heat transfer recording medium of the present invention can stably reproduce a recording image density without causing any pixel point center omission in an image recorded by hot-melt ink, and has good adhesion properties to a desired base.

Examples of Heat Transfer Recording Medium Having Image Receiving Layer/Adhesive Layer Containing First and Second Resin Components Examples 27–29 & Comparative Examples 22–27

25-μm thick transparent polyester films (trademark: Lumirror Q27, manufactured by TORAY INDUSTRIES, INC.) were prepared. The surfaces of these transparent polyester films were coated with a hot-melt ink image receiving layer/adhesive layer coating solution 1 having the following compositions by using a gravure coater, such that the dried film thickness was 6 μm. The obtained coating films were heated and dried at 120° C. for 2 min to form hot-melt ink image receiving layers/adhesive layers, thereby obtaining heat transfer recording media.

| Compositions of hot-melt ink image receiving layer/adhesive layer coating solution 1 | |
|---|---|
| Methylethylketone | 40 parts by weight |
| Toluene | 40 parts by weight |
| Resin mixtures containing first and second resin components mixed at ratios described in Table 10 to be presented later | 20 parts by weight |

On the hot-melt ink image receiving layers/adhesive layers of the obtained heat transfer recording media, color images were recorded by a 600-dpi thermal head by using a commercially available hot-melt ink ribbon, thereby obtaining image layers.

After that, commercially available PPC paper was placed on each image layer, and the resultant structure was passed through Laminator LPD2306 City manufactured by Fujipra K.K., thereby thermally adhering the heat transfer recording medium and the PPC paper to obtain a printed product. The roller temperature and the roller rotating speed of the laminator were adjusted to 180° C. and 1 m/min, respectively.

Each obtained printed product was tested and evaluated for the pixel point shape and the adhesion strength between the heat transfer recording medium and the PPC paper following the same procedures as in Example 23.

The results are shown in Table 10.

In this example, the printed product was obtained by adhering the support member by the easy-adhesion layer. However, when a printed product is to be obtained by peeling the support member, a tape peeling test using an adhesive tape can also be used. In this tape peeling test, the evaluation was ○ if no hot-melt ink image receiving layer/adhesive layer is sticking to the peeled tape; the evaluation was X if the hot-melt ink image receiving layer/adhesive layer is sticking to the peeled tape.

The results are shown in Table 10.

TABLE 10

| | | Hot-melt ink image receiving layer/adhesive layer | | | Pixel point | Adhesion |
|---|---|---|---|---|---|---|
| | | First resin component | Second resin component | Ratio | shape | strength |
| Example | 27 | VYLON 300 manufactured by TOYOBO CO., LTD. Number-average molecular weight: 23,000 Glass transition point: 7° C. | VYLON 220 manufactured by TOYOBO CO., LTD. Number-average molecular weight: 3,000 Glass transition point: 53° C. | 1:9 | ○ | ○ |
| | 28 | VYLON 300 manufactured by TOYOBO CO., LTD. Number-average molecular weight: 23,000 Glass transition point: 7° C. | VYLON 220 manufactured by TOYOBO CO., LTD. Number-average molecular weight: 3,000 Glass transition point: 53° C. | 3:7 | ○ | ○ |
| | 29 | VYLON 300 manufactured by TOYOBO CO., LTD. Number-average molecular weight: 23,000 Glass transition point: 7° C. | VYLON 220 manufactured by TOYOBO CO., LTD. Number-average molecular weight: 3,000 Glass transition point: 53° C. | 5:5 | ○ | ○ |

TABLE 10-continued

| | | Hot-melt ink image receiving layer/adhesive layer | | | Pixel point | Adhesion |
|---|---|---|---|---|---|---|
| | | First resin component | Second resin component | Ratio | shape | strength |
| Comparative Example | 22 | VYLON 300 manufactured by TOYOBO CO., LTD. Number-average molecular weight: 23,000 Glass transition point: 7° C. | VYLON 220 manufactured by TOYOBO CO., LTD. Number-average molecular weight: 3,000 Glass transition point: 53° C. | 0.5:9.5 | ○ | X |
| | 23 | VYLON 300 manufactured by TOYOBO CO., LTD. Number-average molecular weight: 23,000 Glass transition point: 7° C. | VYLON 220 manufactured by TOYOBO CO., LTD. Number-average molecular weight: 3,000 Glass transition point: 53° C. | 6:4 | X | ○ |
| | 24 | None | VYLON 220 manufactured by TOYOBO CO., LTD. Number-average molecular weight: 3,000 Glass transition point: 53° C. | — | ○ | X |
| | 25 | VYLON 290 manufactured by TOYOBO CO., LTD. Number-average molecular weight: 22,000 Glass transition point: 72° C. | VYLON 220 manufactured by TOYOBO CO., LTD. Number-average molecular weight: 3,000 Glass transition point: 53° C. | 5:5 | X | ○ |
| | 26 | VYLON 300 manufactured by TOYOBO CO., LTD. Number-average molecular weight: 23,000 Glass transition point: 7° C. | UE3320 manufactured by UNITIKA, LTD. Number-average molecular weight: 1,800 Glass transition point: 40° C. | 5:5 | ○ | ○ |
| | 27 | VYLON 300 manufactured by TOYOBO CO., LTD. Number-average molecular weight: 23,000 Glass transition point: 7° C. | VYLON 290 manufactured by TOYOBO CO., LTD. Number-average molecular weight: 22,000 Glass transition point: 72° C. | 5:5 | ○ | X |

Examples 30–32 & Comparative Examples 28–33

One surface of a 25-μm thick transparent polyester film (trademark: Lumirror S10, manufactured by TORAY INDUSTRIES, INC.) was coated with a peeling layer coating solution having the following composition by using a gravure coater, such that the dried film thickness was 1 μm. The coating film was heated and dried at 120° C. for 2 min to form a peeling layer.

| Composition of peeling layer coating solution | |
|---|---|
| Methylethylketone | 35 parts by weight |
| Toluene | 35 parts by weight |
| Vinyl acetate resin (trademark: Cevian A700, manufactured by Daiseru Kaseihin K.K.) | 20 parts by weight |

-continued

| Composition of peeling layer coating solution | |
|---|---|
| Polyester resin (trademark: VYLON 220, manufactured by TOYOBO CO., LTD.) | 10 parts by weight |

Subsequently, on this peeling layer, a hot-melt ink image receiving layer/adhesive layer was formed following the same procedures as in each of Examples 27 to 29 and Comparative Examples 22 to 27, thereby obtaining heat transfer recording media.

By using the obtained heat transfer recording media, printed products were obtained in the same manner as in Example 27.

The obtained images were tested and evaluated for the pixel point shape and the adhesion strength in the same manner as in Example 27.

The results are shown in Table 11 below.

TABLE 11

| | | Hot-melt ink image receiving layer/adhesive layer | | | Pixel point | Adhesion |
|---|---|---|---|---|---|---|
| | | First resin component | Second resin component | Ratio | shape | strength |
| Example | 20 | VYLON 500 manufactured by TOYOBO CO., LTD. Number-average molecular weight: 23,000 Glass transition point: 4° C. | VYLON 296 manufactured by TOYOBO CO., LTD. Number-average molecular weight: 14,000 Glass transition point: 71° C. | 1:9 | ○ | ○ |

TABLE 11-continued

| | | Hot-melt ink image receiving layer/adhesive layer | | | Pixel point | Adhesion |
|---|---|---|---|---|---|---|
| | | First resin component | Second resin component | Ratio | shape | strength |
| | 21 | VYLON 500 manufactured by TOYOBO CO., LTD. Number-average molecular weight: 23,000 Glass transition point: 4° C. | VYLON 296 manufactured by TOYOBO CO., LTD. Number-average molecular weight: 14,000 Glass transition point: 71° C. | 3:7 | ○ | ○ |
| | 22 | VYLON 500 manufactured by TOYOBO CO., LTD. Number-average molecular weight: 23,000 Glass transition point: 4° C. | VYLON 296 manufactured by TOYOBO CO., LTD. Number-average molecular weight: 14,000 Glass transition point: 71° C. | 5:5 | ○ | ○ |
| Comparative | 28 | VYLON 500 manufactured by TOYOBO CO., LTD. Number-average molecular weight: 23,000 Glass transition point: 4° C. | VYLON 296 manufactured by TOYOBO CO., LTD. Number-average molecular weight: 14,000 Glass transition point: 71° C. | 0.5:9.5 | ○ | X |
| Example | 29 | VYLON 500 manufactured by TOYOBO CO., LTD. Number-average molecular weight: 23,000 Glass transition point: 4° C. | VYLON 296 manufactured by TOYOBO CO., LTD. Number-average molecular weight: 14,000 Glass transition point: 71° C. | 6:4 | X | ○ |
| | 30 | None | VYLON 296 manufactured by TOYOBO CO., LTD. Number-average molecular weight: 14,000 Glass transition point: 71° C. | — | ○ | X |
| | 31 | VYLON 270 manufactured by TOYOBO CO., LTD. Number-average molecular weight: 23,000 Glass transition point: 67° C. | Ditto | 5:5 | ○ | X |
| | 32 | VYLON 500 manufactured by TOYOBO CO., LTD. Number-average molecular weight: 23,000 Glass transition point: 4° C. | UE3300 manufactured by UNITIKA, LTD. Number-average molecular weight: 8,000 Glass transition point: 45° C. | 5:5 | X | ○ |
| | 33 | VYLON 500 manufactured by TOYOBO CO., LTD. Number-average molecular weight: 23,000 Glass transition point: 4° C. | VYLON 270 manufactured by TOYOBO CO., LTD. Number-average molecular weight: 23,000 Glass transition point: 67° C. | 5:5 | ○ | X |

As is apparent from Tables 10 and 11, when the molecular weights, glass transition points, and mixing ratio of the first and second resin components used in the hot-melt ink image receiving layer/adhesive layer fell within the ranges of the present invention, no center omission occurred in the pixel point shape. Therefore, the reproducibility of the recording image density improved, and satisfactory adhesion strength was obtained.

However, as indicated by Comparative Examples 22, 23, 28, and 29, for example, if the amount of the first resin component was too large, the adhesion strength lowered, and, if the amount of the second resin component was too large, pixel point center omission occurred to worsen the recording image density reproducibility. Also, as indicated by Comparative Examples 25 and 31, if the glass transition point of the first resin component was too high, the adhesion strength lowered. As indicated by Comparative Examples 26 and 32, if the molecular weight of the second resin component was too low, pixel point center omission occurred to worsen the recording image density reproducibility. Furthermore, as indicated by Comparative Examples 22 and 28, if the molecular weight of the second resin component was too high, the adhesion strength lowered. As indicated by Comparative Examples 24 and 30, if no first resin component was used, the adhesion strength lowered.

The examples and comparative examples described above demonstrate that if one of the first and second resin components of the hot-melt ink image receiving layer/adhesive layer is lacking, or if any one of the molecular weights, glass transition points, and mixing ratio of the first and second resin components falls outside the range of the present invention, it is impossible to obtain a good pixel point shape, high recording image reproducibility, and sufficient adhesion strength.

As described above, the third heat transfer recording medium of the present invention can stably reproduce a recording image density without causing any pixel point center omission in an image recorded by hot-melt ink, can form a high-quality image superior in tone reproduction, and has sufficient adhesion to the base.

Also, it is possible by using this heat transfer recording medium to obtain the third printed product of the present invention which can stably reproduce a recording image density without causing any pixel point center omission in an image recorded by hot-melt ink, and which has a high-quality image superior in tone reproduction.

Additional advantages and modifications will readily occur to those skilled in the art. Therefore, the invention in its broader aspects is not limited to the specific details and representative embodiments shown and described herein.

Accordingly, various modifications may be made without departing from the spirit and scope of the general inventive concept as defined by the appended claims and their equivalents.

What is claimed is:

1. A heat transfer recording medium comprising:

a support member;

a protective layer formed on said support member and containing mainly a phenoxy resin; and a thermally adhesive holt-melt ink image receiving layer formed on said protective layer.

2. A medium according to claim 1, wherein said protective layer contains at least one of a polyester resin and epoxy resin as an auxiliary component.

3. A medium according to claim 1, wherein said protective layer has a fusion resistance to vinyl chloride.

4. A medium according to claim 1, wherein the thermally adhesive holt-melt ink image receiving layer is in contact with said protective layer.

5. A heat transfer recording medium comprising:

a support member;

a protective layer formed on said support member and containing mainly a phenoxy resin; and a thermally adhesive sublimating ink image receiving layer formed on said protective layer.

6. A medium according to claim 5, wherein said protective layer contains at least one of a polyester resin and epoxy resin as an auxiliary component.

7. A medium according to claim 5, wherein said protective layer has a fusion resistance to vinyl chloride.

8. A printed product comprising:

a protective layer containing mainly a phenoxy resin;

a thermally adhesive hot-melt ink image receiving layer stacked on said protective layer;

a hot-melt ink image received on said hot-melt ink image receiving layer; and a base thermally adhered to said hot-melt ink image receiving via said hot-melt ink image.

9. A product according to claim 8, wherein said protective layer contains at least one of a polyester resin and epoxy resin as an auxiliary component.

10. A product according to claim 8, wherein said protective layer has a fusion resistance to vinyl chloride.

11. A printed product comprising:

a protective layer containing mainly a phenoxy resin;

a thermally adhesive sublimating ink image receiving layer stacked on said protective layer;

a sublimating ink image received on said sublimating ink image receiving layer; and a base thermally adhered to said sublimating ink image receiving layer via said sublimating ink image.

12. A product according to claim 11, wherein said protective layer contains at least one of a polyester resin and epoxy resin as an auxiliary component.

13. A product according to claim 11, wherein said protective layer has a fusion resistance to vinyl chloride.

* * * * *